US006650853B1

(12) United States Patent
Sumikawa et al.

(10) Patent No.: US 6,650,853 B1
(45) **Date of Patent: *Nov. 18, 2003**

(54) IMAGE RECORDING APPARATUS AND METHOD WITH IMPROVED IMAGE TRANSFER CHARACTERISTICS

(75) Inventors: Takeshi Sumikawa, Ashigarakami-gun (JP); Kazuo Maruyama, Ashigarakami-gun (JP); Hideaki Tanaka, Ashigarakami-gun (JP); Takeshi Nagao, Ashigarakami-gun (JP); Tomoo Kobayashi, Minami Ashigara (JP); Isao Ito, Ashigarakami-gun (JP); Michiaki Takahashi, Minami Ashigara (JP); Masashi Ogasawara, Ashigarakami-gun (JP); Shigeo Ohno, Ashigarakami-gun (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/753,475

(22) Filed: Nov. 26, 1996

(30) Foreign Application Priority Data

Nov. 27, 1995 (JP) ..... 7-329412
Oct. 18, 1996 (JP) ..... 8-295959

(51) Int. Cl.[7] ..... G03G 15/22

(52) U.S. Cl. ..... 399/147; 399/149; 399/302; 399/308

(58) Field of Search ..... 399/149, 297, 399/302, 308, 127, 147, 296, 319, 398

(56) References Cited

U.S. PATENT DOCUMENTS 4,353,648 A * 10/1982 Tanaka et al. ..... 399/398 X
5,084,735 A * 1/1992 Rimai et al. ..... 399/302
5,210,577 A * 5/1993 Nowak ..... 399/296
5,241,342 A * 8/1993 Asano et al. ..... 399/127 X
5,329,341 A * 7/1994 Nowak et al. ..... 399/319
5,666,193 A * 9/1997 Rimai et al. ..... 399/308

FOREIGN PATENT DOCUMENTS

| | | |
|---|---|---|
| JP | 52-126230 | 10/1977 |
| JP | 53-125027 | 11/1978 |
| JP | A-54-109842 | 8/1979 |
| JP | A-54-121133 | 9/1979 |
| JP | A-56-126872 | 10/1981 |
| JP | A-58-88770 | 5/1983 |
| JP | A-58-140769 | 8/1983 |
| JP | 58-209754 | * 12/1983 |
| JP | A-59-133573 | 7/1984 |
| JP | A-59-157661 | 9/1984 |
| JP | A-64-20587 | 1/1989 |
| JP | A-1-134485 | 5/1989 |
| JP | 1-267676 | * 10/1989 |
| JP | A-2-1870 | 1/1990 |
| JP | A-2-81053 | 3/1990 |
| JP | A-2-118671 | 5/1990 |
| JP | A-2-118672 | 5/1990 |
| JP | A-2-157766 | 6/1990 |
| JP | A-3-114063 | 5/1991 |
| JP | A-3-172880 | 7/1991 |

* cited by examiner

*Primary Examiner*—Fred L. Braun
(74) *Attorney, Agent, or Firm*—Oliff & Berridge, PLC

(57) ABSTRACT

An image recording apparatus includes an image carrying part, a developing part and an image transferring part. The image carrying part has a surface on which an electrostatic latent image is formed. The developing part develops the electrostatic image into a toner image by selectively applying toner to the surface of the image carrying part. The image transferring part transfers the toner image onto a recording sheet or an intermediate image transferring part. Fine particles are uniformly formed on the surface of the image carrying part, and a portion of the fine particles is transferred from the image carrying part with the toner image. The fine particles are smaller in diameter than the toner particles.

18 Claims, 23 Drawing Sheets

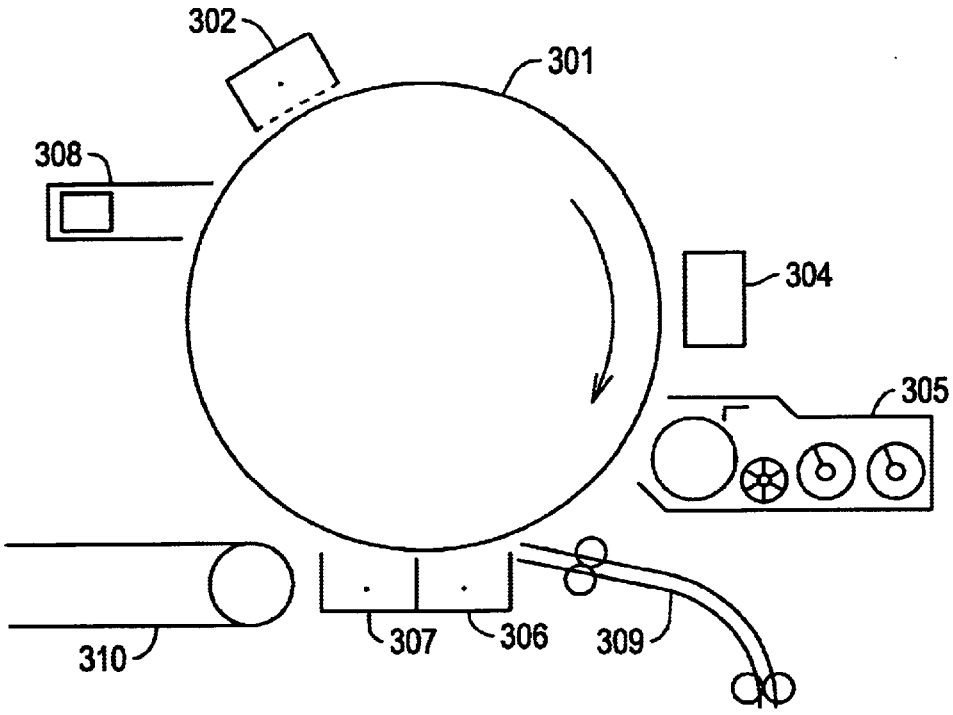
Fig. 8A
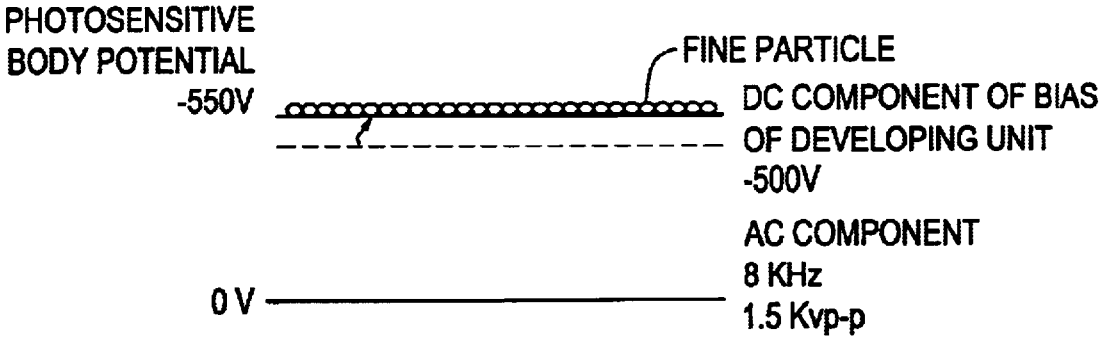
Fig. 8B AT FORMING FINE PARTICLE LAYER
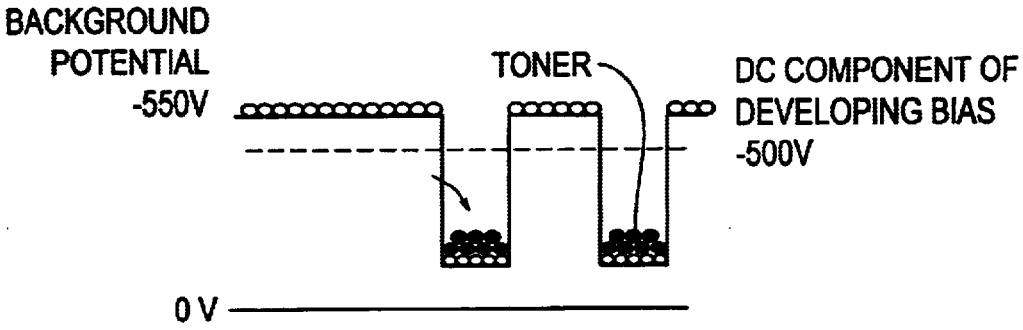
Fig. 8C AT DEVELOPING

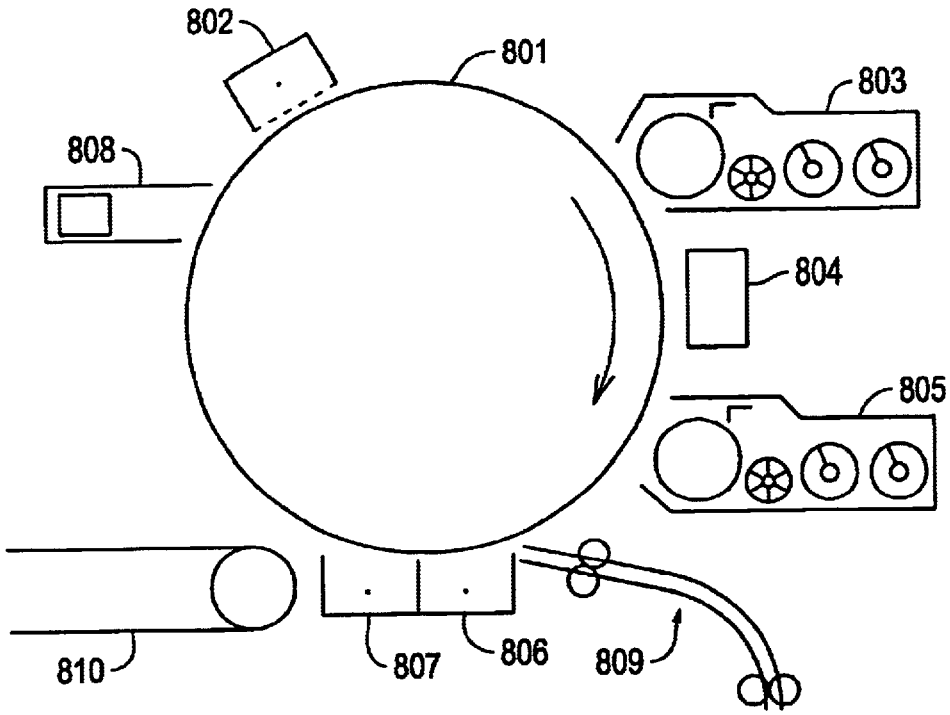
Fig. 22A
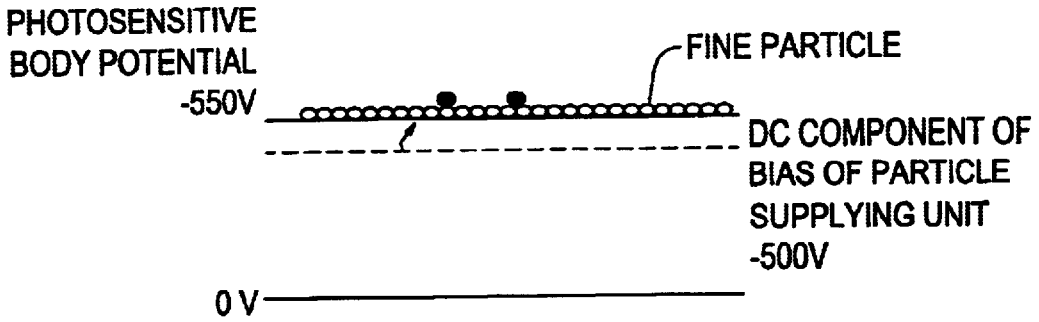
Fig. 22B AT FORMING FINE PARTICLE LAYER
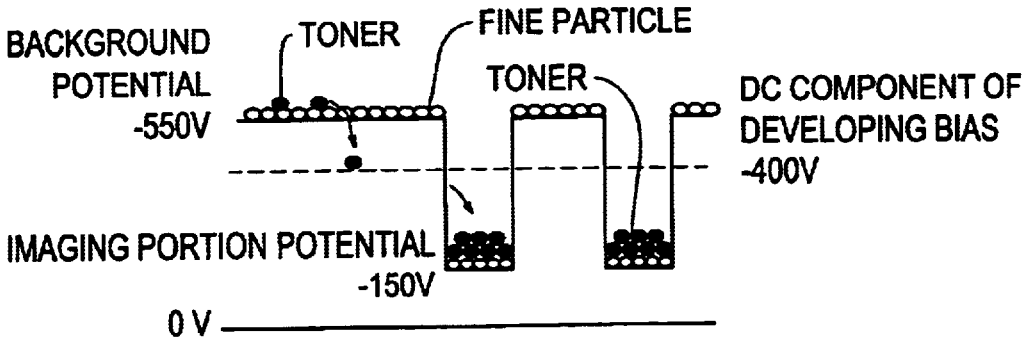
Fig. 22C AT DEVELOPING

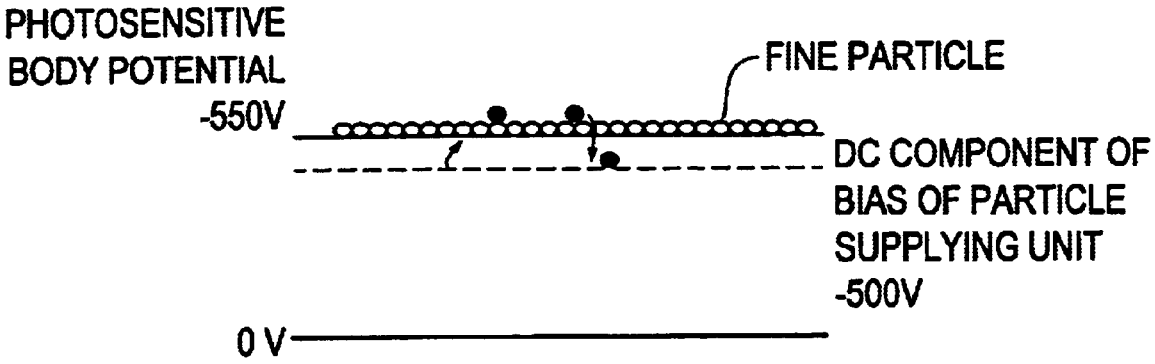
Fig. 23 AT FORMING FINE PARTICLE LAYER

IMAGE RECORDING APPARATUS AND METHOD WITH IMPROVED IMAGE TRANSFER CHARACTERISTICS

BACKGROUND OF THE INVENTION

1. Field of the Invention

The present invention relates to an image recording apparatus of the type in which a latent image is formed on a latent image carrier, developed into a toner image, and the toner image is transferred onto a recording medium or an intermediate image transfer body, and an image recording method used in the apparatus. More particularly, the invention relates to an image recording apparatus based on electrophotographic image recording technique, electrostatic recording technique, ionography, magnetography or the like, and an image recording method used in the image recording apparatus.

2. Description of the Related Art

The indirect image transfer type image recording technique records an image on a recording paper in a manner that a toner image is formed on an image carrier, and the formed image is transferred onto the paper and then fixed onto the same. Generally, residual toner is collected which is still left on the image carrier after the toner image is transferred onto the paper, and a user disposes of the collected toner.

To record an image, the indirect transfer type image recording technique performs a process consisting of the following steps oft 1) charging uniformly the surface of an image carrier, which is coated with a photosensitive material;
2) exposing the uniformly charged surface of the image carrier to light containing image information to form an electrostatic latent image thereon;
3) developing the electrostatic latent image into a toner image;
4) transferring the toner image onto a recording paper;
0 5) fixing the toner image onto the paper by fusing toner; and
6) cleaning the surface of the image carrier by removing the toner that is still left on the surface of the image carrier after the transferring step ends.

In the cleaning step, the residual toner is removed with an elastic rubber blade or a brush in such a way that it is pressed against the surface of the image carrier, and the removed toner is collected in a container and periodically cast.

In this type of the image forming apparatus, an amount of toner accumulatively stored in the container is constantly detected and measured. Before the container is filled up with the collected toner, the toner has to be cast or the old container has to be replaced with a new empty container. In case where the image recording apparatus is reduced in size, it is difficult to secure a large space for receiving the collected toner container. Because of this, the inner space of a drum-like image carrier Is frequently used for storing the collected toner. This necessitates the setting up of a period of replacing the image carrier with a new one on the basis of the amount of the collected toner.

An attempt to reuse the collected toner has been made in view of the environment protection. However, the attempt involves many problems of sorting and transporting of the collected toner, energy for toner reuse, gathering ways and sites of cast toner, and the like.

The followings are possible solutions to the problems.

1) A first solution is to improve the efficiency of transferring the toner image onto the recording medium. If the transferring efficiency is improved, the amount of the residual toner on the image carrier is correspondingly reduced and the amount of toner to be collected and cast is also reduced.
2) A second solution is to return the collected residual toner to the developer, and to use it for the development again. Since the collected toner is completely reused, there is eliminated the work to cast the toner.
3) A third solution is such that the cleaning of the image carrier is not performed, and unwanted phenomena, for example, ghost, caused by the residual toner is removed by another means. If the unwanted phenomena by the residual toner are removed, it is not necessary to clean the image carrier for the residual toner removal, and the toner to be cast is not produced.

Conventional techniques for improving the transferring efficiency are listed below.

a) Unexamined Japanese Patent Publication (kokai) No. Sho. 56-126872 discloses that's
   an area where an electric field for transferring is formed is increased to improve the transferring efficiency.
b) Unexamined Japanese Patent Publication (kokai) Nos. Sho. 58-88770 and 58-140769 disclose that:
   an alternative electric field is formed at the image transferring location, and this field applies a force so that the toner on the image carrier is swingably moved to accelerate the removal of the toner from the image carrier.
c) Unexamined Japanese Patent Publication (kokai) No. Sho. 52-126230 discloses that's
   an ultrasonic wave is projected onto the image transferring area on the image carrier, and with the ultrasonic wave, the image transferring area is vibrated to reduce the adhesion of toner particles.
d) Unexamined Japanese Patent Publication (kokai) Nos. Hei. 2-1870, 2-81053, 2-118671, 2-118672, and 2-157766 disclose that:

Separable fine particles of silica or the like are contained in the developing agent so that those fine particles intervene between the toner and the photoreceptor. Therefore, the adhesion acting between the toner and the photoreceptor is reduced to improve the transferring efficiency.

e) Unexamined Japanese Patent Publication (kokai) No. Hei. 1-134485:

For the latent image development, colorless and transparent toner is applied to a latent image formed on the image carrier, and colored toner is applied to the resultant latent image. In the thus formed toner image, the color toner particles are transferred almost perfectly.

The above techniques (a), (b) and (c) succeed in improving the transferring efficiency. However, some amount of toner is still left on the image carrier after the image transferring step ends. Accordingly, these techniques fail to provide a perfect solution to the problem of reducing the amount of casting toner.

In the technique (d), it is required to add a sufficient amount of separable fine particles to the developing agent and to coat toner particles with the separable fine particles. Actually, it is difficult to perfectly and uniformly coat all the toner particles with the separable fine particles. And, it is difficult to completely remove the tone particles imperfectly coated with the separable fine particles. Even if all the toner particles are uniformly coated with the separable fine particles, the separable fine particles often separate from the toner particles when those toner particles covered with the separable fine particles undergo various types of stresses, such as agitation, controlling of the layer thickness and the like. To maintain such a state that all the toner particles are uniformly coated with the separable fine particles, a developing unit must be constructed such that the toner particles coated with the separable fine particles are free from stress. Since a large number of separable fine particles are added to the toner, when the toner is used for a long time, the separable fine particles adhere to the surface of toner and carrier, the charging characteristic of the developing agent degrades, and the separated fine particles gather into agglomeration. This degrades the fluidity of the developing agent, possibly causing an irregular development. The toner containing a large amount of separable fine particles has a good fluidity. Accordingly, when a toner image contacts with an image transfer body in the image transferring process, the toner image tends to lose its shape. The deformation of the image caused by the image transferring process tends to occur.

In the technique (e), after the transferring of the toner image, much colorless and transparent toner is left on the surface of the image carrier. The surface of the image carrier before the next image forming process have to be cleaned so that a uniform surface of the image carrier is secured. The work to collect the residual toner by the cleaning unit and cast the collected one is essential. Accordingly, the technique (d) can not solve the problem of reducing the amount of the toner to be cast.

The followings are conventional techniques for reusing the collected toner referred to (2).

1) Unexamined Japanese Patent Publication (kokai) No. Sho. 54-121133 discloses that toner collected by the cleaning unit is returned to the developing unit by way of a transporting path, and used again for developing latent images.

2) Unexamined Japanese Patent Publication (kokai) No. Sho. 53-125027 discloses that:

the cleaning unit and the developing unit are combined into a single unit, and toner collected by the cleaning unit is caused to fall into or transported to a container containing toner for development.

The technique for collecting residual toner on the image carrier by the developing unit, not using the cleaning unit is disclosed in Unexamined Japanese Patent Publication (kokai) Nos. Sho. 54-109642, 59-133573, 59-157661 and the like.

In the image recording apparatuses based on the above technique, after the transferring process of the toner image, the toner left on the background portion is collected by transferring the toner onto the developing roll In the electric field in the developing region before the next image is developed.

In the image recording apparatuses disclosed in Unexamined Japanese Patent Publication (kokai) Nos. Sho. 54-121133, 53-125027, 54-109842, 59-133573, 59-157661, the collected toner is not accumulatively stored. The paper powder, which is mixed with the toner during the image transferring process, is also collected by the developing unit. This causes an image defective. When the toner is repeatedly used, the charging characteristic of the toner varies, so that the image density is often instable. For this reason, the developing agent contained in the developing unit must be replaced with new one. In this case, the old toner must be cast. In the case of the image recording apparatus which additionally uses a device for transporting the toner to the developing unit, the apparatus structure is complicated.

The conventional technique not using the cleaning process is disclosed in Unexamined Japanese Patent Publication (kokai) Nos. Hei. 3-172880 and Sho. 64-20587.

If the image carrier is not cleaned after the image transferring process, a positive ghost and a negative ghost may appear on the recorded image. The positive ghost is formed when the residual toner is printed out in the next image forming process. The negative ghost is formed by the light interruption by the residual toner. In Unexamined Japanese Patent Publication (kokal) No. Hei. 3-172880, in order to prevent the ghost, the toner transferring efficiency is set at 80% or larger. In Unexamined Japanese Patent Publication (kokai) No. Hei. 3-114063, the amount of residual toner is set at 0.35 mg/cm$^2$ or less, to thereby prevent the ghost.

In the technique disclosed in Unexamined Japanese Patent Publication (kokai) No. Sho. 64-20587, after the image transferring process, the residual toner is agitated with a brush or the like to thereby prevent the formation of the ghost by the residual toner.

To suppress the formation of the ghost and fog in those apparatuses, the transferring efficiency has to be improved.

It is seen that the transferring efficiency has to be improved in order to reduce the toner to be collected and cast to the smallest possible amount.

Further, in order to reduce the toner to be cast to zero, it is necessary to improve the transferring efficiency so that the formation of image defects, such as ghost and fog, are suppressed without the cleaning operation for removal of the residual toner that follows the transferring process.

SUMMARY OF THE INVENTION

It is an object of the present invention to reduce the amount of the toner to be collected and cast by improving the efficiency of transferring the toner image onto a recording sheet or an intermediate image transfer body so as to eliminate the use of the cleaning unit, and to simplify the construction of the image recording apparatus and to suppress the occurrence of the toner to be cast so as to maintain a high transferring efficiency stably for a long time.

An image recording apparatus according to the present invention comprises: an image carrying unit having a surface on which an electrostatic latent images is formed; a developing unit for developing the electrostatic latent image into a toner image by selectively applying toner to the surface of the image carrying unit; and an image transferring unit for transferring the toner image onto a recording sheet or an intermediate image transferring body; wherein fine particles are uniformly formed on the surface of the image carrying unit, the particle diameter of the fine particles being smaller than that of the toner, and the toner is transferred onto the fine particles on the surface of the image carrying unit.

An Image recording method comprises the steps of: forming an electrostatic latent image defined by electrostatic potential differences on image carrying unit having a uniform layer of fine particles formed on the surface thereof, the particle diameter of the fine particles being smaller than that of the toner; forming a toner image by selectively applying toner onto the layer of the fine particles; and transferring the toner image to a recording shoot or an intermediate image transferring unit.

In the indirect-transfer type printing apparatus or method of the present invention, a fine particle layer is uniformly formed on the image carrier before the toner image formation, and a toner image is formed on the fine particle layer. This unique feature brings about advantages. A first advantage is to considerably improve a toner image transfer rate. A second advantage is to reduce the toner collected from the image carrier having undergone the image transfer process to zero or considerably reduce the same.

BRIEF DESCRIPTION OF THE DRAWINGS

In the accompanying drawings:

FIGS. 8A to 8C are views schematically showing an image recording apparatus according to a third embodiment of the present invention;

FIGS. 22A to 22C are a views schematically showing an image recording apparatus according to a ninth embodiment of the present invention;

FIG. 23 is an explanatory diagram for explaining the operation of the image recording apparatus, when the toner left on the image carrier having undergone the image transferring process is collected by a particle supplying unit;

DETAILED DESCRIPTION OF THE INVENTION

Figure 1:
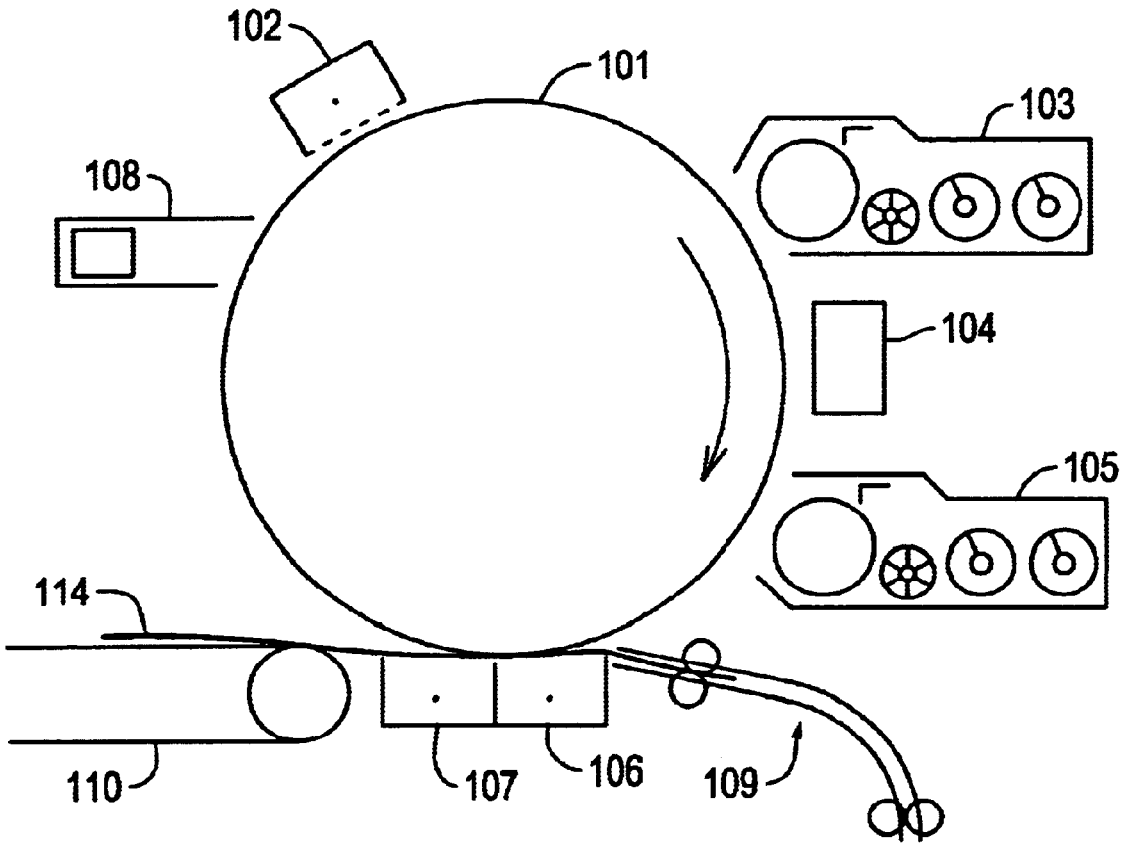
FIG. 1 is a view schematically showing an indirect transferring type image recording apparatus according to a first embodiment of the present invention.

To solve the problems, in image recording apparatus and method of the present invention, powdery particles of which the particle diameter is smaller than that of the toner particles are transferred to the surface of the image carrier to form substantially uniform layer of the powdery particles thereon. Toner particles to visualize an electrostatic latent image into a toner image are transferred onto the powdery particle layer, so that a toner image is formed layered on the powdery particle layer.

Generally, toner particles adhere to the image carrier by electrostatic force (sometimes by magnetic force). At this time, nonelectrostatic force, e.g., Van der Waals force, also acts for the adhesion. Formation of the toner image layered on the powdery particle layer sets up a such that a gap is present between the toner particles and the image carrier or a state that a contact area between the toner particles and the image carrier is small. This states reduces the nonelectrostatic force. In this state, if an electric field is applied to the toner image layered on the powdery particle layer when the toner image is transferred, the toner particles are easily separated and transferred at an image transfer ratio of approximately 100%.

When the image recording apparatus is an apparatus in which the image carrier with a photosensitive layer is exposed to image light to form an electrostatic latent image or the image recording method is a method in which the image carrier with a photosensitive layer is exposed to image light to form an electrostatic latent image, if the powdery particles are made of light transmission material, an exact electrostatic latent image can be formed in a manner that the image carrier is uniformly charged, and a uniform fine particle layer iv formed on the charged image carrier and exposed to image light. Accordingly, a picture formed by developing the electrostatic latent image with toner is clear.

The fine particles may uniformly be applied onto the image carrier before the image recording apparatus is used or in factory. Alternatively, the fine particles may uniformly be applied onto the image carrier by the particle supplying means when the apparatus is first used. The particle supplying means can also make up a deficiency of the fine particles, or the fine particles have been transferred from the image carrier to a recording sheet or the like, together with toner. It is preferable that the fine particles are uniformly layered on the image carrier every time image formation occurs.

The means for transferring the powdery particles onto the image carrier may be realized variously. A first example of the means has the same construction as of the developing unit and contains powdery particles instead of color toner. A second example of the means contains a developing agent containing toner and powdery particles, and also operates as a developing unit. In the second example of the particle supplying means, which has the functions of the particle supplying means and the developing unit, the powdery particles are uniformly layered on the surface of the image carrier before an electrostatic latent image is formed thereon, and an electrostatic latent image is formed thereon and toner is applied to the electrostatic latent image. Alternatively, the powdery particles contained in a developing agent are transferred, together with toner, onto the image carrier, to thereby form or hold a uniform layer of powdery particles.

There are many methods for making the fine particles electrically adhere to the image carrier, in addition to the method employed in the developing unit. In a first method, the fine particles are dispersed into a cloud of fine particles, and transferred onto the image carrier in an electric field. In a method for dispersing the fine particles into a cloud of fine particles, mechanical variation, air, ultrasonic and alternate electric field are used for dispersing the toner particles. In another method, fine particles are applied to a tool like roll, brush, web, or the like, and the tool with the fine particles is rotated, vibrated or moved to disperse the fine particles. In yet another method, the fine particles are mechanically rubbed against the image carrier by a magnetic brush consisting of fine particles magnetically chained like ears, a soft elastic roller, felt, or the like. This method may be used in combination with the mechanical method.

In an additional method, an adhering layer is formed on the image carrier, and fine particles are applied. Material having adhesive properties stable with time is preferable for the adhesive layer. An example of such material is silicone oil, chemically stable and low in volatility.

The volume resistivity of the fine particles Is preferably within the range from $1\times10^{8}$ Ωcm to $1\times10^{14}$ Ωcm. If the thus conditioned fine particles are used, the amount of fine particles transferred from the image carrier to a recording sheet, for example, is reduced. As a result, a desired state of the fine particle layer is stably maintained, to thereby secure a good and stable transferring of the toner image.

The reason why the good results as described above are brought about by the present invention will be described hereinunder.

The fine particles intervene between the toner particles and the image carrier to reduce an adhesion acting therebetween, and to improve the image transferring efficiency. After the toner image is transferred, most of the fine particles are left on the image carrier. Part of the fine particles are transferred, together with the toner particles, when the image transferring process is carried out. The amount of fine particles transferred has a correlation with a volume resistivity of fine particles made to adhere to the image carrier. The fine particles, when high in volume resistivity, are easy to be transferred, together with toner particles, in the image transferring process. The fine particles, when low in volume resistivity, are easy to remain on the image carrier. This nature arises from the charging characteristic of fine particles. The fine particles adhering to the surface of the image carrier, when high in volume resistivity, are easily charged when the image carrier is charged. If the charge polarity of the Image carrier is negative, for example, the fine particles are also negatively charged. At this time, the potential by the charge of the fine particles is lower than the potential of the image carrier, but it reaches a value of several % to several tens % of the latter depending on the volume resistivity thereof. The fine particles that are charged in the same polarity as of the image carrier, when placed in an electric field of the opposite polarity in the image transferring process, are transferred in part together with the toner particles by electrostatic force (Coulomb attraction). Therefore, if the volume resistivity of the fine particles is selected to be low, a value of approximately $1\times10^{14}$ Ωcm or lower, there is no chance that the fine particles are undesirably charged. Accordingly, the fine particles are little transferred to the surface of the image carrier in the image transferring process. The presence of the fine particle layer is maintained on the image carrier.

If the volume resistivity of the fine particles is approximately $1\times10^{14}$ Ωcm or lower, charge moves through the fine particles on the image carrier, so that the electrostatic latent image on the image carrier is unclear (the resultant image gets blurred).

In the construction of the invention described above, the fine particle layer is formed on the image carrier. In case where the image recording apparatus uses an intermediate image transfer body, the fine particle layer may be formed on the intermediate image transfer body. In this case, the toner image can be transferred from the intermediate image transfer body to a recording sheet or another intermediate image transfer body highly efficiently.

The invention of the present patent application provides another means (involving the apparatus and the method) for improving the efficiency of the image transferring. In this means, the toner image formed on the image carrier is vibrated by an ultrasonic wave before it is transferred to a recording sheet or another intermediate image transfer body.

The ultrasonic wave is applied to the toner particles in the area where mechanical and electric forces do not act on the toner image on the image carrier. The toner particles rise to the surface of the image carrier. A contact area of the toner particles with the surface of the image carrier is reduced and hence an adhesion acting between them is also reduced. In this state, if an electrical force acts to attract the toner particles from the image carrier to the recording sheet, for example, the toner particles are easily separated from the image carrier, to thereby secure a high efficient transferring of toner particles.

While in the above construction, the ultrasonic wave is projected to the toner image formed on the image carrier before it is transferred to the recording sheet or the intermediate image transfer body, the ultrasonic wave may be projected to the toner image formed on the intermediate image transfer body before it is transferred to the recording sheet or the additional intermediate image transfer body. In this case, the toner image can be efficiently transferred to the recording sheet or another intermediate image transfer body.

The invention further provides image recording apparatus and method which can reproduce a good picture without the cleaning unit by making use of the means for improving the Image transferring efficiency.

In the apparatus and the method may selectively use the following means to dispose of the toner left on the image carrier having undergone the image transferring process.

In the first means, the residual toner is collected by the developing unit. Since the residual toner is collected by the developing unit, image defects, such as ghosts, are not caused. Since the image transferring efficiency is improved, the amount of the collected residual toner is small, so that the toner in the developing unit is little affected.

In a second means, the particle supplying means is provided separately from the developing unit, and collects the residual toner. In this case, the residual toner may be collected using an electric field formed between it and the image carrier or by a magnetic brush, which brushes away the residual toner from the surface of the image carrier.

The second means effectively prevents the formation of image defects, for example, ghosts, and prevents foreign materials, for example, paper powder, from entering the developing unit.

In a third means, the residual toner are layered on the subsequently formed image, not collected, and transferred to a recording sheet or an intermediate image transfer body when the new toner image is transferred.

The third means (involving the apparatus and the method) transfers the toner image highly efficiently to such an extent as not to form image defects (ghosts, for example) by the transferring efficiency improving means. Accordingly, this means prevents foreign materials, for example, paper powder, from entering the developing unit, and the toner to be collected and cast from being produced.

The preferred embodiments of the present invention will be described with reference to the accompanying drawings.

First Embodiment

FIG. 1 is a view schematically showing an indirect transferring type image recording apparatus according to a first embodiment of the present invention.

The image recording apparatus is made up of an image carrier 101, and other devices disposed around the image carrier 101. Those devices are: a charging unit 102, a particle supplying unit 103, an image writing unit 104, a developing unit 105, a transfer charging unit 106, a paper stripping charging unit 107, a paper transporting belt 110, and a charge-removal exposure unit 108. The image carrier 101 is uniformly charged and exposed to light containing image information, so that an image is formed on the image carrier 101. The charging unit 102 uniformly charges the surface of the image carrier 101. The particle supplying unit 103 forms a layer of fine particles made of light transmission material, uniform in thickness, on the surface of the image carrier 101 after it is uniformly charged The image writing unit 104 forms an electrostatic latent image on the surface of the image carrier 101 by exposing the surface thereof to the light controlled in accordance with image data. The developing unit 105 visualizes the electrostatic latent image by selectively applying toner onto the electrostatic latent image. The transfer charging unit 106 transfers the toner image from the surface of the image carrier onto a paper supplied from a paper guide. The paper stripping charging unit 107 stripe the paper with the toner image transferred thereonto from the image carrier. The paper transporting belt 110 transports the paper stripped off the image carrier. The charge-removal exposure unit 108 removes the charge from the electrostatic latent image carrier.

In the charging unit 102, to uniformly charge the surface of the image carrier 101, a high voltage is applied to the electrode wire to cause a corona discharge between the wire and the surface of the image carrier 101.

The image writing unit 104 includes a number of light emitting elements or diodes (LEDs) arrayed in the width direction of an image formed. The LEDs are driven in accordance with image signals to emit light to the surface of the image carrier 101.

Figure 2:
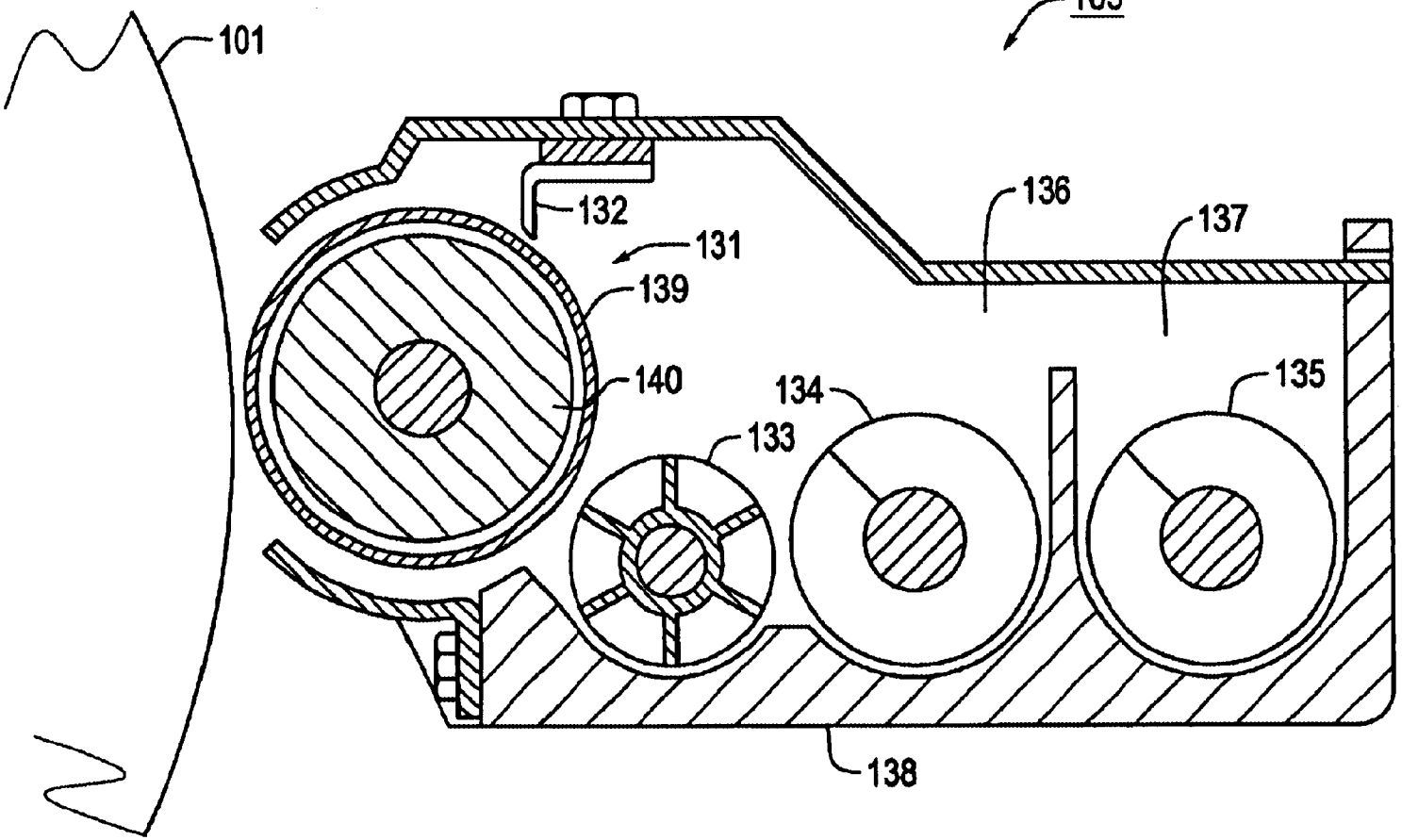
FIG. 2 is a sectional view showing a developing unit used in the image recording apparatus shown in FIG. 1.

The developing unit 105, as shown in FIG. 2, includes a cylindrical developing roll 131 disposed facing and in proximity to the image carrier 101, and a developing-agent controlling member 132 for controlling the amount of developing agent on a developing roll 131.

The developing roll 131 includes a magnetic roll 140 with a plural number of magnetic poles circumferentially arrayed thereon, and a nonmagnetic, hollowed cylindrical sleeve 139 rotatably supported around the magnetic roll 140. The developing roll 131 transports a developing agent in a state that the developing agent is magnetically attracted on the outer surface of the sleeve 139.

A paddle 133, located behind the developing roll 131, supplies an developing agent to the developing roll 131. First and second agitating chambers 136 and 137 are provided in back of the paddle 133. First and second augers 134 and 135 are disposed in the first and second agitating chambers 136 and 137, respectively. These augers feed the developing agent in the axial direction of the developing roll 131.

The developing agent used in the developing unit 105 is a mixture of magnetic carrier and toner. If necessary, an additive may be added to the mixture. The developing agent will be described in detail later.

The particle supplying unit 103 has the same construction as of the developing unit 105. A fine particle supplying agent as a mixture of magnetic carrier and light transmission powdery material, instead of the developing agent, is contained in the particle supplying unit 103. The powdery material will be described in detail.

The performances and major components of the image recording apparatus thus constructed are specified as follows:

| | |
|---|---|
| Photoreceptor | OPC (ϕ84) |
| ROS | LED (400 dpi) |
| Process speed | 160 mm/s |
| Latent image potential | −550 V at background<br>−150 V at image portion |
| Developing roll | Fixed magnet<br>Sleeve rotating method<br>Magnet flux density: 500 G (on the sleeve)<br>Sleeve diameter: 25 ϕ<br>Sleeve rotating speed: 300 mm/s |
| Gap between photoreceptor and developing roll | 0.5 mm |

-continued

| | |
|---|---|
| Gap between developing-agent controlling member and developing roll | 0.5 mm |
| Developing bias | DC component: −500 V<br>AC component: 1.5 kVp-p (8 kHz) |
| Fine particle supplying agent carrying roll | Same as of the developing roll |
| Gap between photoreceptor and fine particle supplying agent carrying roll | 0.5 mm |
| Gap between layer-thickness controlling member and developing roll | 0.5 mm |
| Developing bias applied to the fine particle supplying agent carrying roll | Equal to that of the developing bias |
| Image transferring condition | Corotron transfer (wire diameter: 85 μm) |

The developing agent used in the developing unit 105 shown in FIG. 2 will be described.

<<Toner>>

The toner used may be formed in the following manner. Polyester (number-average molecular weights 4,300, weight-average molecular weight: 9,800, Tg—58° C.) of 94 wt % and cynian blue (manufactured by DAI NICHI SEIKA corporation in Japan) of 6 wt % are kneaded and ground, to thereby form colored toner particles of 7 μm in average particle diameter. Titanium oxide fine particles of 40 nm in average particle diameter is added to the colored toner particles, to form thian toner. In this case, a ratio of the covering area to the toner surface area is 30%. The charge polarity of the toner is negative. The average particle diameter of the toner was measured by a coulter counter (Mulisizer made by COULTER corporation).

The covering ratio f (%) is expressed by:

$$f(\%)=(\sqrt{3}\times dt\times\rho t\times Wa)/(2\times\pi\times da\times\rho a\times Wt)\times 100 \quad (1)$$

where dt (m): average particle diameter of toner;

da (m): average particle diameter of titanium oxide fine particles;

ρt: specific weight of toner;

ρa: specific weight of titanium;

Wa(kg) a weight of oxide titanium fine particles;

Wt (kg): toner weight.

The specific weight of the toner is 1.0 and the specific weight of the titanium oxide fine particles is 4.5.

Generally, the particle diameter of toner greatly influences the picture quality of the recorded picture. As the particle diameter becomes larger, the picture is coarse. If the average particle diameter of the toner is approximately 20 μm, no problem arises in practical use. To increase the resolution of fine lines, it is preferable to use the toner of 10 μm or smaller in the average particle diameter. As the toner diameter becomes smaller, a physical adhesion acting between the toner and the carrier is extremely large, and the developing capability decreases. Further, where the toner diameter is small, the toner tends to cohere. Accordingly, difficulty arises in handling the toner. For this reason, the average particle diameter of the toner used in the invention is preferably within the range of 5 μm to 10 μm.

The following resin materials an well as polyester resin used in the above case may be used for the main binder resin. The resin materials are: polystyrene, styrene-propylene copolymer, styrene-butadiene copolymer, styrene-vinyl chloride copolymer, styrene-vinyl acetate copolymer, styrene-acrylic acid ester copolymer, styren-methacrylate ester copolymer, polyurethane, and the like. A single or a plural number of binder resin material, if necessary, may be mixed into any of the above resin materials. To improve the mold release characteristics to prevent the toner offset during the heat-roll fixing process, olefin family element, for example, ethylene, propylene, and the like, or its copolymer, and such wax component as carnauba wax may be added to the main binder resin. In this case, a preferable amount of the wax component to be added is within 0.5 wt % to 10 wt %. If the amount of the wax component added is smaller than any of the values with the above range, the wax component cannot exhibit its effect. If it is larger than any of the values within the range, the toner tends to be deformable. If it is deformed, the charging characteristics of the developing agent vary, leading to an instable image density.

To increase the physical strength of the toner or the cohering force of the toner during the heat-roll fixing process to prevent the toner offset, high polymer of which the weight-average molecular weight is 100000 or larger or cross link polymer may be contained In the main binder resin. The content of the high polymer or the cross link polymer is preferably 60% or loss by weight of the toner. If it is 60 wt % or greater, the fusing of the toner for the fixing process is inadequate, and a poor fixing of the image is secured.

The coloring material of the black color, which is for coloring the toner, may be carbon black, nigrosine, graphite, or the like.

The coloring materials of the chromatic color may be as follows:

(Yellow or Orange Pigment)

C.I. pigment orange 31, C.I. pigment orange 43, C.I. pigment yellow 12, C.I. pigment yellow 14, C.I. pigment yellow 17, C.I. pigment yellow 93, C.I. pigment yellow 94, C.T. pigment yellow 138, and C.I. pigment yellow 174.

(Magenta or Red Pigment)

C.I. pigment red 5, C.I. pigment red 48, C.I. pigment red 53, C.I. pigment red 57, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

(Thian or Green Pigment)

C.I. pigment green 7, C.I. pigment blue 15, C.I. pigment blue 15: 2, C.I. pigment blue 15: 3, C.I. pigment blue 60.

The content of the toner coloring material is preferably within the range of 0.5% and 20% by weight of the toner. If it is 0.5 wt % or leas, the color development is unuatisfactory and a clear picture cannot be obtained. If it exceeds 20 wt %, a density of the picture is irregular because of poor dispersion of the coloring material in the toner.

<<Carrier>>

The carrier to be used in the developing unit 105 shown in FIG. 2 will be described hereinunder by way of example.

styrene-acryl copolymer (number-average molecular weights 23,000, weight-average molecular weight-average molecular weight : 98,000, Tg=78° C.) of 30 wt %, carbon black (basic carbon blacks pH=8.5) of 3 wt %, and particulate magnetite (maximum magnetization:80 emu/g, particle diameter 0.5 μm) of 67 wt % were kneaded, ground, and sorted, to thereby obtain carrier particles of 45 μm in average particle diameter. The charge polarity of the carrier is positive, the electric resistance (volume resistivity) thereof is $10^{12}$ Ωcm, and the specific gravity thereof is 2.2. The average particle diameter was measured by MICRO TRACK (manufactured by NIKKI-SO corporation).

The carrier thus formed is a called polymer carrier formed by mixing the magnetic fine particles into the polymer.

Instead of this, a magnetic particle carrier may be used which consists of metallic particles of iron, ferrite, magnetite or the like. The polymer carrier is lower in magnetization than the magnetic particle carrier. Accordingly, it can form a soft, high density magnetic brush, and will provide a picture of high quality. A further advantage of the polymer carrier is that when it adheres to the image carrier, it will little damage the surface of the image carrier. The polymer carrier has a further advantage. Since the specific gravity of the carrier is small, the mass of it is also small. Accordingly, when the developing agent is mixed in the developing unit, a reduced stress acts on the toner, so that the lifetime of the developing agent is long. In the case of the magnetic particle carrier, its specific gravity is large, and hence its mass is large. When the developing agent is mixed in the developing unit, a large stress acts on the toner. However, the developing agent is quickly charged. For this reason, in using the polymer carrier or the magnetic particle carrier, either of these carriers may properly be selected in accordance with the performances required for the image recording apparatus.

As for the particle diameter of the carrier, the density of the magnetic brush becomes larger as the particle diameter becomes smaller. The increasing of the density of the magnetic brush distinctly appears when the average particle diameter is 60 $\mu$m. In case where the particle diameter of the carrier is small, e.g., the average particle diameter is 35 $\mu$m or shorter, the magnetic binding force of the carrier is weak. Under this condition, the carrier will adhere to the image carrier. For this reason, the average particle diameter of the carrier particles is preferably within the range of 35 $\mu$m and 60 $\mu$m.

<<Developing Agent>>

Such a developing agent that the toner concentration (TC) is 15 wt %, and the charge amount of the toner in the developing agent is 20 $\mu$C/g may be used for the developing agent as a mixture of the toner and the carrier.

The TC is expressed by:

$$TC\ (\text{wt }\%) = (\text{weight of the toner contained in the developing agent})(g)/(\text{total amount of the developing agent})(g) \times 100 \quad (2)$$

In the developing agent formed by mixing the toner with the carrier, if the charge amount of the toner is too large, an adhesion of the toner to the carrier is too intensive, so that the toner fails to develop the latent image. If the charge amount of the toner is too small, the adhesion of the toner to the carrier is weak, so that a toner cloud is formed and appears as a fog on the recorded picture. To secure a good development by transferring the toner to the latent image, the charge quantity of the toner in the developing agent is 5 to 50 $\mu$C/g in absolute value, preferably 10 to 40 $\mu$C/g.

<<Fine Particle Supplying Agent>>

The fine particle supplying agent used in the particle supplying unit 103 will be described.

The fine particle supplying agent is a mixture of powdery particles of which the particle diameter is smaller than of the toner, and the same carrier as of the developing agent. The fine particles to be made to adhere to the image carrier are fine particles of polymethyl methacrylate, 40 nm in average particle diameter.

The powdery particles of polymethyl methacrylate may be substituted by powdery particles of an inorganic material or an organic material. The inorganic material may bet titanium oxide, alumina, silica, titanic acid barium, titanic acid calcium, titanic acid strontium, zinc oxide, magnesium oxide, zirconium oxide, barium oxide, barium carbonate, calcium carbonate, silicon carbide, silicon nitride, chromium oxide, red oxide, or the like. The organic material may be; polyacrylate, polymethyl methacrylate, polyethylene, polypropylene, polyvinylidene fluoride, polytetrafluoroethylene, or the like. To secure an environmental stability, it is desirable that the fine particles are less hygroscopic. If the fine particles are made of an inorganic material, for example, titanium oxide, alumina, silica or the like, the material must be treated so as to have a hydrophobic property. The inorganic fine particles may be made hydrophobic by making an agent for hydrophobicity react with the fine particles at high temperature. Silane coupling agent (e.g., dialkyldihalogenoilane, trialkylhalogenosilane, and alkyltrihalogennosilane) and dimethyl silicon oil may be enumerated for the agent, for hydrophobicity.

In case where the light-interruption effect already referred to must specially be taken into account to secure a satisfactory picture quality, an organic material preferable for the fine particles is an acrylic material of good transparency, e.g., polyacrylate, polymethacrylate, and polymethyl methacrylate, and a preferable inorganic material is silica because the light interruption effect is low. Such a material (e.g., zinc stearate and magnesium stearate) that forms a film on the image carrier with time is unsuitable for the powdery particles since it will easily form a film also on the toner particles and the adhesion of them to the toner will be strong.

As for the adhesion of the fine particles to the image carrier, no problem arises if one or a plural kinds of fine particles are present between the toner and the image carrier. What is essential is that the particles intervene between the toner and the image carrier and can reduce the adhesion acting therebetween.

Our consideration on the average particle diameter of the fine particles will be given.

There Is a chance that the powdery particles adhere to the toner image or are mixed Into the toner image and transferred to the recording paper. Accordingly, some measure must be taken so as not to disturb the toner image or not to give rise to a color irregularity or drop. For this reason, the powdery particles of which the particle diameter is smaller than of the toner particles are used. To secure a satisfactory reproduction of fine lines and mesh points, it is preferable that the particle diameter of the fine particles is small. In this respect, 5 $\mu$m or smaller is preferable for the particle diameter.

A mixture ratio of the powdery material and the carrier is adjusted so that the covering ratio of the powdery fine particles to the carrier is 100%. The mixing ratio may be varied in accordance with a kind of the powdery material used.

Incidentally, the covering ratio may be calculated using the equation (1).

The operation of the indirect image transfer type image recording apparatus thus constructed will be described. The operation constitutes an embodiment of the present invention.

Figure 3A:
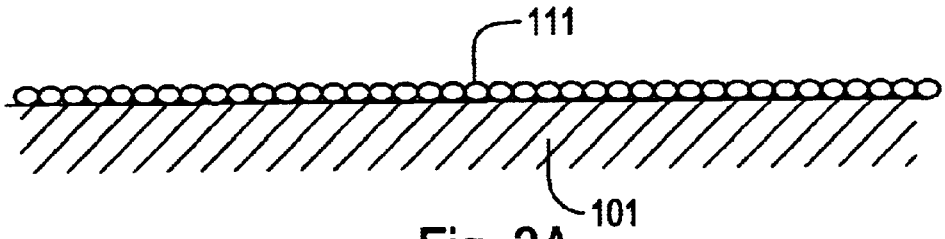
FIGS. 3A to 3D are explanatory diagrams useful in explaining an operation of the image recording apparatus shown in FIG. 1.

The image carrier 101, shaped like a drum, is driven to turn. With the turn, the surface of the image carrier 101 is uniformly charged by the image carrier 10 and the uniformly charged surface reaches a location where it faces the particle supplying unit 103. A magnetic brush of carrier particles is formed on the surface of the particle-supplying-agent carrying roll of the particle supplying unit 103 by the magnetic roll. The fine particles of polymethyl methacrylate adhere to the carrier particles. The magnetic brush comes in contact with the image carrier 101 to rub the powdery particles of the magnetic brush against the image carrier and to form a fine particle layer 111, substantially uniform thick, on the surface of the image carrier 101, i.e., an intervening layer on the surface of the image carrying means, as shown in FIG. 3A. Since the particle diameter of the powdery particles is short, the quantity of charge of each particle is small. Accordingly, the electric force generated by the powdery particles is not large. When the powdery particles come in contact with the surface of the image carrier 101, an attraction force, e.g., Van der Waals attraction, acts on the contact surface, so that the powdery particles adhere to the surface of the image carrier.

Figure 3B:
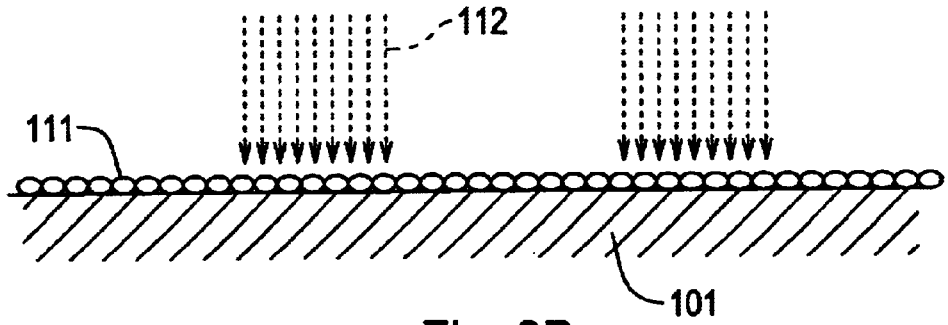

In the location where the image carrier surface faces the image writing unit 104, as shown in FIG. 3B, image light beams vertically hit the particle layer. The fine particles used allows light to transmit therethrough. Because of this, the photosensitive layer of the image carrier Is exposed to the image light. At this time, the photosensitive layer loses its charge, so that electrostatic potential differences are distributively formed in the photosensitive layer, and an electrostatic latent image is formed which is defined by the potential differences.

Figure 3C:
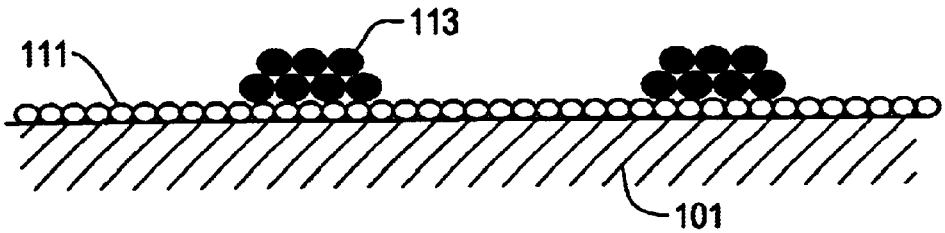
Figure 3D:
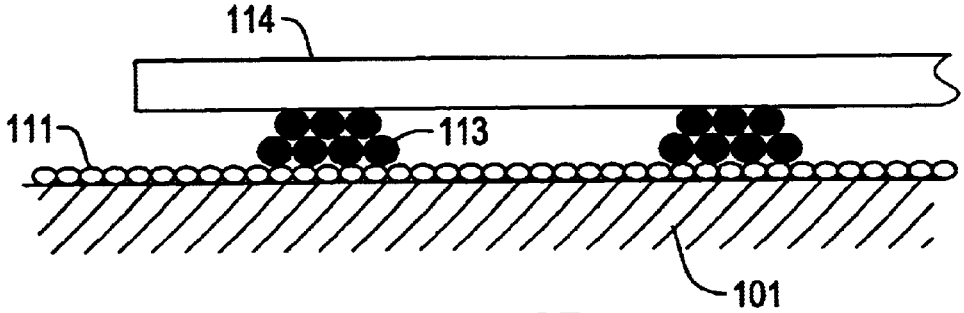

The electrostatic latent image thus formed moves to a location facing the developing unit 105. Toner 113 that is supplied from the developing roll 131 is put on the fine particle layer as shown in FIG. 3C, to thereby visualize the electrostatic latent image with the supplied toner. The toner image thus formed is transferred onto a recording paper 114 by the image transferring unit, as shown in FIG. 3D. It is noted here that the toner 113 is applied to the image carrier 101 in a state that the fine particle layer 111 is placed therebetween, and that a nonelectric adhering force, e.g., the Van der Waal force, is weak. Accordingly, the toner image is easily stripped off the surface of the image carrier 101 under an electric field developed by the image transferring unit, and transferred to the recording paper 114.

After the toner image is transferred onto the recording paper, the fine particle layer is left on the surface of the image carrier 101. It is noted that the image recording apparatus under discussion is not provided with the cleaning unit. Accordingly, in operation, the apparatus executes the next image forming process in a state that the fine particle layer is layered on the image carrier, and in this process, the particle supplying unit 103 makes up a deficiency of the fine particles on the surface of the image carrier. Incidentally, in the image transferring process, a part of the fine particles are transferred from the image carrier to the recording paper, causing the deficiency of the fine particles on the image carrier.

If an image transfer ratio is 100%, no residual toner is present on the surface of the image carrier. Actually, a little toner Is left on the surface of the image carrier, however. The residual toner, in the next image forming process, is partly collected by the particle supplying unit 103 and the developing unit 105, and the toner still left reaches the image transferring location while being carried on the image carrier 101, and transferred to the recording paper, together with the next toner image.

A cleaning unit may be provided downstream of the transfer charging unit in the image recording apparatus. In this case, if the fine particles are completely collected by the cleaning unit, a great amount of collected fine particles is produced and further fine particles must be supplied anew. For this reason, it is necessary to use the cleaning unit which can collect only the toner while leaving the fine particle layer on the image carrier, for example, a cleaning unit capable of collecting only the toner by using the electrical force.

Figure 4:
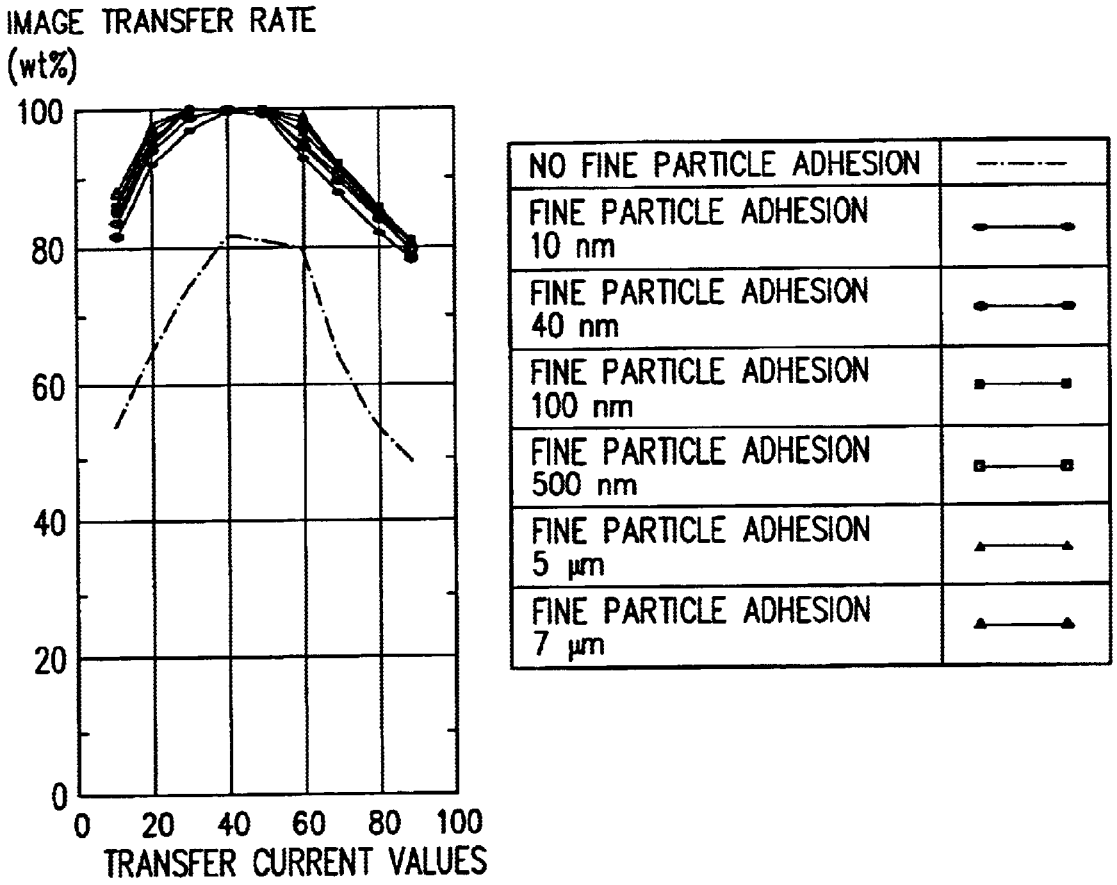
FIG. 4 is a graph showing a variation of the image transfer ratio with respect to an image transferring current when a toner image is transferred from the image carrier onto a recording sheet or paper in the image recording apparatus of FIG. 1.

The results of our experiment conducted for evaluating the image transferring characteristic of the image recording apparatus thus constructed are shown in FIG. 4.

In the measurement, the image transfer rates were measured while varying the transfer current values. The powdery particles used by the particle supplying unit were made of polymethyl methacrylate, and the average particle diameters thereof were 40 nm, 10 nm, 100 nm, 500 nm, 5 $\mu$m and 7 $\mu$m. To confirm the useful effects of the invention, the image transfer ratio was measured in a state that the particle supplying unit is not operated.

The image transfer ratio is defined by:

$$\text{Image transfer ratio (\%)}=\{(\text{weight of the toner transferred to the image transfer material})(g)/(\text{weight of the toner developed on the image carrier})(g)\}\times 100 \quad (3)$$

As seen from the graph, the image transfer ratio of the toner image is remarkably improved by forming the fine particle layer on the image carrier before the toner image formation, and if the transfer current value is selected so as to fall within a proper range of the current values (approximately 40 $\mu$A to 50 $\mu$A in the image recording apparatus of the embodiment), the image transfer ratio reaches about 100%. It was observed that the image transfer ratio increased with increase of the particle diameter of the powdery particles, but the increase of the image transfer rate was negligible. Up to 5 $\mu$m of the particle diameter of the particles of polymethyl methacrylate, the picture quality was substantially invariable. When it is increased to 7 $\mu$m, the picture quality was improved to such an extent as to offer no problem in practical use except that a subtle irregularity was observed in fine lines. It is thought that this arises from the fact that the toner image is a little disturbed when it is transferred since the particle diameter of the polymethyl methacrylate particles is large. Therefore, 5 $\mu$m or less is preferable for the particle diameter to secure a satisfactory image quality.

Also In the experiment using the image recording apparatus, the image formation of 20,000 sheets was performed in a state that the transfer current of the image transferring corotron was fixed at 40 $\mu$A. The positive ghost that will be formed on the next image by the residual toner was not observed. The image formation was performed in state that the particle supplying unit is removed from the image recording apparatus, and accordingly the polymethyl methacrylate particles did not adhere to the photoreceptor. A positive ghost clearly appeared on the next image. 20,000 number of images were successively printed, and subsequently the toner transferring characteristic was evaluated while varying the transfer current of the transferring corotron. Little variation was observed on the image transfer ratio and the relationship between the image transfer ratio of the toner and the transfer current value.

COMPARISON

The experiment that was conducted to confirm the useful effects obtained by the image recording apparatus or the results of the invention will be described.

A first experiment will be given. In the experiment, the image recording apparatus was operated in a state that the particle supplying unit is made standstill. After the operation, the residual toner left was collected by a cleaning unit additionally installed into the apparatus, and the amount of the residual toner was measured.

1000 images were successively printed. Toner of approximately 50 g was consumed for the image formation. The amount of toner collected by the cleaning unit was approximately 10 g. In this state, if 20,000 images are further formed, toner of 1000 g will be consumed for the development, and the residual toner of 200 g will be collected and cast. Meanwhile, as recalled, in the image recording apparatus of the present embodiment, the image transfer ratio is approximately 100% and little toner to be cast is produced. When comparing these facts, it is clearly seen that the image recording apparatus of the embodiment succeeds in achieving the object to reduce the toner to be cast.

A second experiment for confirming the results of the invention will be described below. In this experiment, zinc stearate was used for the powdery particles that are to be transferred to the image carrier before the toner image formation, although polymethyl methacrylate was used for the same in the embodiment described above.

The image transfer ratio was approximately 100% at the start of printing operation, and in this state successive printing operations were performed. In an initial stage, the residual toner was not produced after the image transfer process is completed. When about 100 sheets were printed, the residual toner started to increase its amount and continued the increase of the toner amount with increase of the number of prints. After the printing of 500 sheets, the toner image transfer ratio was measured again, and was 90% or less. The surface of the photoreceptor was analytically observed. The result was that the zinc stearate particles were deformed to form a film on the photoreceptor, and toner was stuck to the zinc stearate film. It was further observed that a film of zinc stearate were formed on the surface of each of the carrier particles that were mixed with the zinc stearate particles to form the fine particle supplying agent. From the result of the experiment, it is taught that such a material hard as to be deformed and filmed must be selected for the powdery particles that are to be made to adhere to the surface of the image carrier.

Second Embodiment

An image recording apparatus of a second embodiment of the present invention will be described.

Figure 5:
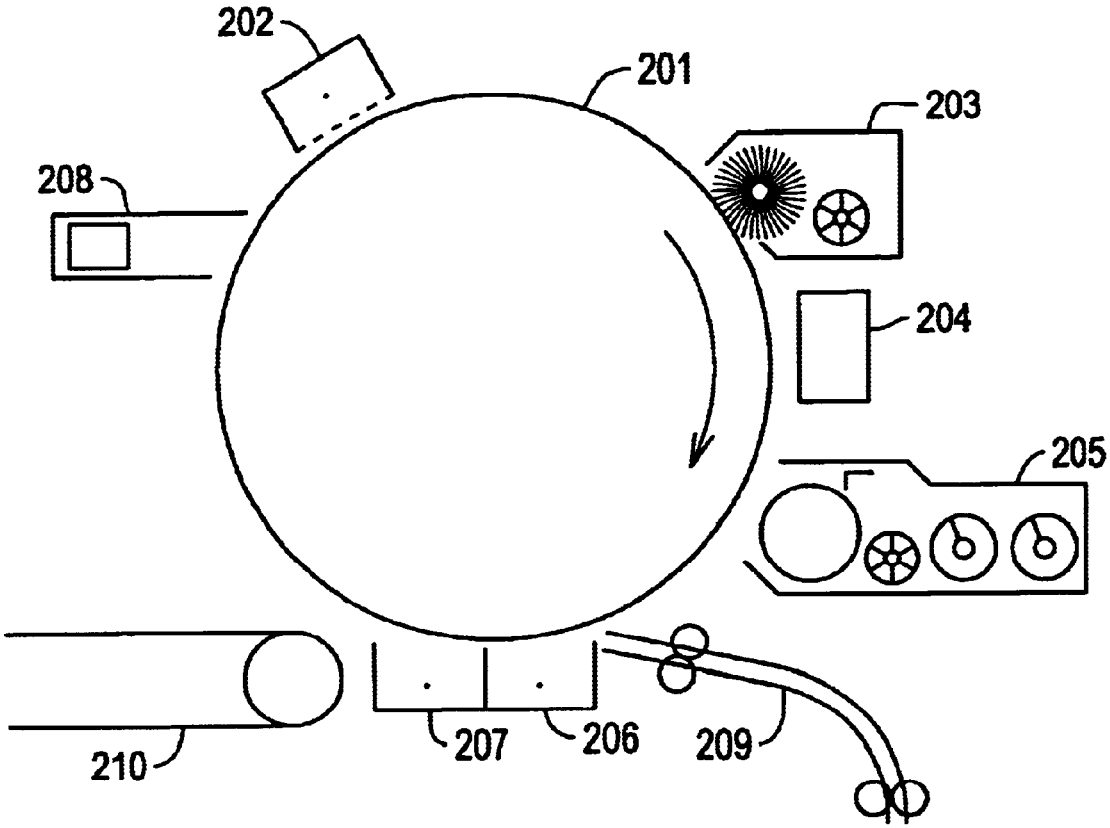
FIG. 5 in a view schematically showing an image recording apparatus according to a second embodiment of the present invention.

FIG. 5 is a view schematically showing an image recording apparatus according to the second embodiment of the present invention.

In the image recording apparatus of the second embodiment, another particle supplying unit 203 with a brush that is rotatable in contact with an image carrier 201 is used in place of the particle supplying unit 103 used in the apparatus shown in FIG. 1. The construction of the particle supplying unit 203 is illustrated in detail in FIG. 6. As shown, a rotary brush 231 is provided in the opened end of a housing 234 for containing powdery particles. A paddle 232 for supplying the powdery particles to the rotary brush 231 is located at the rear of the rotary brush 231. In a portion where the rotary brush 231 comes in contact with the image carrier 201, the filament tips of the rotary brush 231 is driven to move in the same direction as of the movement of the surface of the image carrier 201. The peripheral speed of the filament tips is slightly higher than that of the image carrier 201. The powdery particles contained in the particle supplying unit 203 are the same as used in the FIG. 1 apparatus. That is, the powdery particles contained are 40 nm in the average particle diameter of 40 nm and made of polymethyl methacrylate. However, the powdery particles are not mixed with carrier particles.

The remaining construction of the apparatus, which includes the image carrier 201, a charging unit 202, an image writing unit 204, a developing unit 205, a transfer charging unit 206, a paper stripping charging unit 207, a paper guide 209, and a paper transporting belt 210, is the same as of the image recording apparatus of FIG. 1.

In the image recording apparatus, the paddle 232 sprinkles the powdery particles of polymethyl methacrylate, which is contained in the housing 234 of the particle supplying unit 203, over the filament tips of the rotary brush 231. A bar like member 233 is disposed in parallel with the rotary brush 231. With the turn of the rotary brush 231, the filaments thereof are put against the bar like member 233, to bring the powdery particles down by shaking. Then, the filament tips are moved to the contact portion of the rotary brush 231 with the image carrier 201. In the contact portion, the filament tips of the rotary brush come in contact with the surface of the image carrier to rub the powdery particles against the surf ace of the image carrier. At this time, between the fine particles and the image carrier, a large electric force, interactively acting therebetween, is not present, but nonelectric, strong adhesion acts and hence fine particles adhere to the surface of the image carrier to form a fine particle layer thereon.

Thereafter, image light bombards the fine particle layer, and a toner image is formed and transferred as in the image recording apparatus shown in FIG. 1. At this time, the toner image is efficiently transferred.

Figure 7:
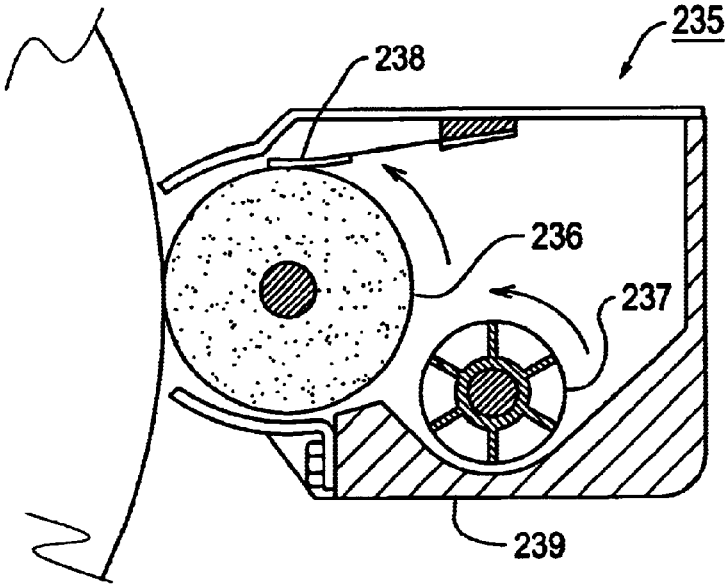
FIG. 7 is a sectional view schematically showing another particle supplying unit used for the image recording apparatus of FIG. 5.

In the image recording apparatus of the second embodiment, the above-mentioned particle supplying unit may be substituted by another particle supplying unit constructed as given below. This particle supplying unit is shown in FIG. 7 and designated by reference numeral 235. As shown, an elastic roll 236 is disposed so as to come in contact with the surface of an image carrier 201. The powdery particles, which are supplied to the surface of the elastic roll by a paddle 237, are smoothed with a blade 238 and rubbed against the surface of the image carrier to form a uniform particle layer thereon.

Various ways can be applied to realize the function of the particle supplying unit may be realized in various ways. In a first example, a felt or brush, fixedly supported, is brought into contact with the surface of the image carrier, and the powdery particles are properly supplied to and rubbed against the contact portion of them. In a second example of the particle supplying unit, such a fine mesh as to allow the fine particles to pass therethrough is brought into contact with the image carrier, and the powdery particles are supplied to the surface of the image carrier through the mesh, thereby forming a uniform layer of fine particles on the surface of the image carrier.

Third Embodiment

An image recording apparatus according to a third embodiment of the present invention will be described with reference to FIGS. 8A to 8C.

In the image recording apparatus of the present embodiment, the fine particle supplying unit is incorporated into a developing unit 305. That is, the particle supplying unit does not take the form of an independent unit. The developing unit 305 has the same construction as of the image recording apparatus of FIG. 1 or 5. However, a developing agent contained in the developing unit 305 is different from that used in the already described apparatus.

The developing agent of the present embodiment consists of toner and fine silica particles of 50 nm in average particle diameter, which are contained so that the covering ratio of the fine particles to the toner is 50%. The surface of the image carrier 301 of the apparatus is coated with fluoroplautic. The fluoroplastic is provided for reducing a nonelectric adhesion between the surface of the image carrier and a fine particle layer to be formed. With provision of the fluoroplastic layer, in a portion having a large adhesion of the toner particles to the fine particle layer, the fine particles are allowed to be transferred together with the toner particles, to thereby secure a high image transfer ratio.

The adhesion of the fine particle layer to the Image carrier surface may also be reduced by shaping the surface of the image carrier so as to have irregularities of which the peak to peak distance is shorter than the particle diameter of the fine particles. In this case, the area where the image carrier surface contacts with the fine particles is reduced. The contact area reduction leads to reduction of the adhesion of the fine particles to the image carrier surface.

The remaining construction of the image recording apparatus of the third embodiment is substantially the same as of the apparatus of FIG. 1 or 5.

In operation, the surface of the image carrier 301 is uniformly charged by a charger 302 (FIG. 8E), passes a location where it faces an image writing unit 304 without being exposed to image light, and reaches a location where it faces the developing unit 305. As seen from FIG. 8C, a DC superposed AC voltage is applied to between the surface of the image carrier and the developing roll. Under the application of the voltage, fine particles of silica are clouded and transferred to the image carrier, so that a fine particle layer, substantially uniform, is formed on the surface of the image carrier.

The surface of the image carrier 301 on which the fine particle layer is thus formed passes the locations where it faces a transfer charging unit 306, a charge-removal exposure unit 308, and the charger 302, which are not operated, and returns to the location where it faces the image writing unit 304. In this location, the surface with the fine particle layer formed thereon is exposed to image light to have an electrostatic latent image formed thereon. The latent image is visualized at the location where it faces the developing unit 305. At this time, toner supplied from the developing roll adheres to the fine particle layer, so that a toner image is formed over the fine particle layer. The toner image Is transferred to an incoming recording paper guided by a paper guide 309, by the transfer charging unit 306. Since the toner image is formed on the fine particle layer as in the apparatus of FIG. 1 or 5, the toner image is transferred at a high image transfer rate.

Figure 9:
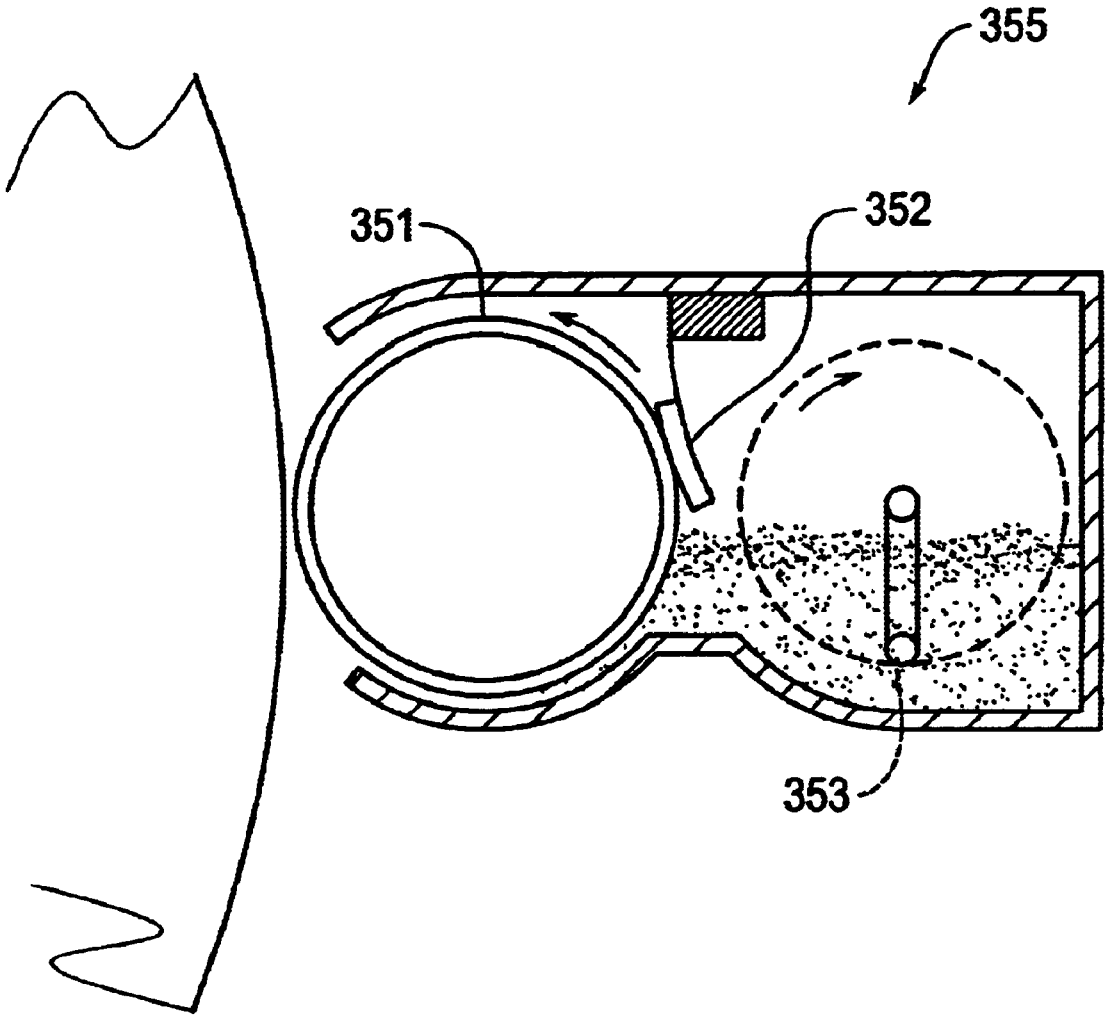
FIG. 9 is a sectional view schematically showing a developing unit that may be used in place of the developing unit shown in FIG. 2, in the image recording apparatus of FIG. 1, 5 or 6.

In the image recording apparatuses of FIGS. 1 and 5, the developing agent contained in the developing units is of the two-component type. If required, a one-component type developing agent may be used instead of the two-component type one, as shown in FIG. 9.

A developing unit 355 supplies a nonmagnetic one-component developing agent to the surface of a developing roll 351. The developing agent is smoothed to be a thin layer by a blade 352. Then, the thin layer of the developing agent is positioned so as to face the image carrier and transferred onto the surface of the image carrier.

The toner and the additive used for the developing unit will typically be given below.

For the developing unit exclusively used for the developing operation, like the developing unit of FIG. 1 or 5, the developing agent used is a mixture of nonmagnetic toner (containing styrene acrylic resin as a main component) of 7$\mu$m in average particle diameter, and fine silica particles (of which the average particle diameter is 5 $\mu$m) of 0.7% by weight of the toner.

For the developing unit of the type which forms a fine particle layer in a first cycle and develops an electrostatic latent image in a second cycle, like the developing unit of FIG. 8A, a developing agent used is a mixture of the same nonmagnetic toner, fine silica particles (of which the average particle diameter is 15 $\mu$m) of 0.7 wt % and fine silica particles (of which the average particle diameter is 40 $\mu$m) of 0.3 wt %.

A bias voltage applied to the developing unit may be set as follows:

For the fine particle layer formation;

[AC of 1.5 kvp-p and at 1.5 kHz]+[−400 V DC]

For the developing operation;

−500 V DC

Fourth Embodiment

Figure 10:
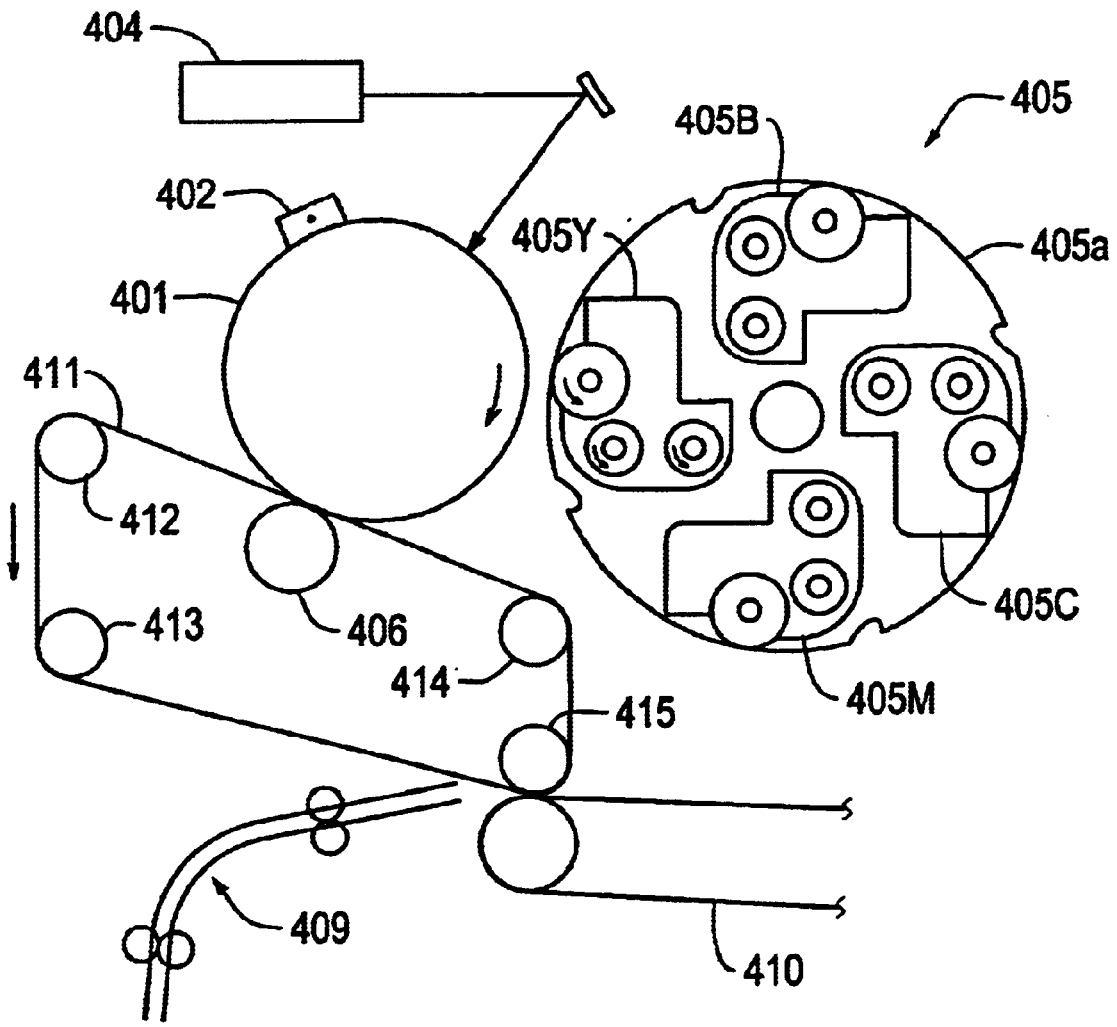
FIG. 10 is a view schematically showing an image recording apparatus according to a fourth embodiment of the present invention.

FIG. 10 is a view schematically showing an image recording apparatus according to a fourth embodiment of the present invention. The image recording apparatus of the present embodiment is designed for forming a full color image.

The apparatus is made up of an image carrier 401 with a photosensitive layer formed thereon, a charger 402 for uniformly charging the surface of the image carrier 401, an image writing unit 404 for forming an electrostatic latent image on the uniformly charged surface of the image carrier 401 by Irradiating the surface thereof with image light, a developing unit 405 containing four developing subunits respectively containing yellow, magenta, cyan and black toner, an intermediate image transfer belt 411 as an endless belt rotatably stretched around rollers 412 to 415, a transfer roll 406 for transferring a toner image from the image carrier 401 to the intermediate image transfer belt 411, a second image transfer roll 415 for transferring the toner image from the intermediate image transfer belt 411 onto a recording paper, which is delivered being guided by a paper guide 409, and a belt 410 for transporting the recording paper with the toner image transferred thereonto.

The four developing subunits 405Y, 405M, 405C and 405B are supported by a single base member 405*a*, which is rotatable. With the turn of the base member 405*a*, those subunits are successively positioned at the location where each of them faces the image carrier, and in proximity to the image carrier. The subunits supply their color toner to the corresponding electrostatic latent images, to thereby visualize the latent images, viz., form color toner images.

The developing agent used for those developing subunits will be given below.

The carrier may be the same as used by the image recording apparatus of FIG. 1. The same binder is used for the color toner. Pigments used are different in color but equal in equal average particle diameter. An additive in fine silica particles of 50 nm in average particle diameter. The fine silica particles are contained so that a covering ratio of the fine silica particles to the toner particles is 50%.

The intermediate image transfer belt 411 is an endless belt, 137 $\mu$m thick, made of carbon black dispersed in polycarbonate resin. The electric resistance of the belt is $10^8\Omega$ to $10^{9\Omega}$. The intermediate image transfer belt 411 and the image carrier 401 are driven to turn at peripheral speed of 160 mm/s in the direction of an arrow. Those members are not provided with cleaning units.

In the image recording apparatus, a first cycle of the image carrier is used as a dummy mode based on the yellow developing subunit, subsequently toner images of the remaining colors are formed on the image carrier, and those color toner images are superposedly transferred onto the intermediate image transfer belt 411.

Specifically, the image carrier 401 is driven to turn. Through the turn, the surface of the image carrier is uniformly charged by the charger 402. The charged surface is moved to a location where it faces the yellow developing subunit 405Y, without being exposed to image light. Here, the charged surface thereof receives fine silica particles uniformly, so that a fine silica particle layer is formed on the charged surface of the image carrier. Thereafter, the resultant surface of the image carrier is exposed to image light, so that an electrostatic latent image is formed on the surface thereof. The electrostatic latent image is visualized, by the yellow developing subunit 405Y, into a yellow toner image. The yellow toner image is then transferred onto intermediate image transfer belt 411 by the transfer roll 406. Since the toner image thus formed is layered on the fine particle layer, it is transferred at the image transfer ratio of approximately 100%.

For the remaining colors, cyan, magenta and black, the image carrier 401 is repeatedly subjected to the toner image forming process consisting of charging, exposure to image light, and formation of a color toner image, and the transfer process of the resultant color toner image to the intermediate image transfer belt 411. Consequently, those toner images of four colors are superposed to form a full color toner image on the intermediate image transfer belt 411. The full color toner image is then transferred onto a recording paper by the second transfer roll 415. In this way, a full color image is recorded on the paper.

The image recording apparatus thus constructed is capable of forming a quality color image not using the cleaning unit and not collecting the residual toner from the surface of the image carrier 401.

Figure 11:
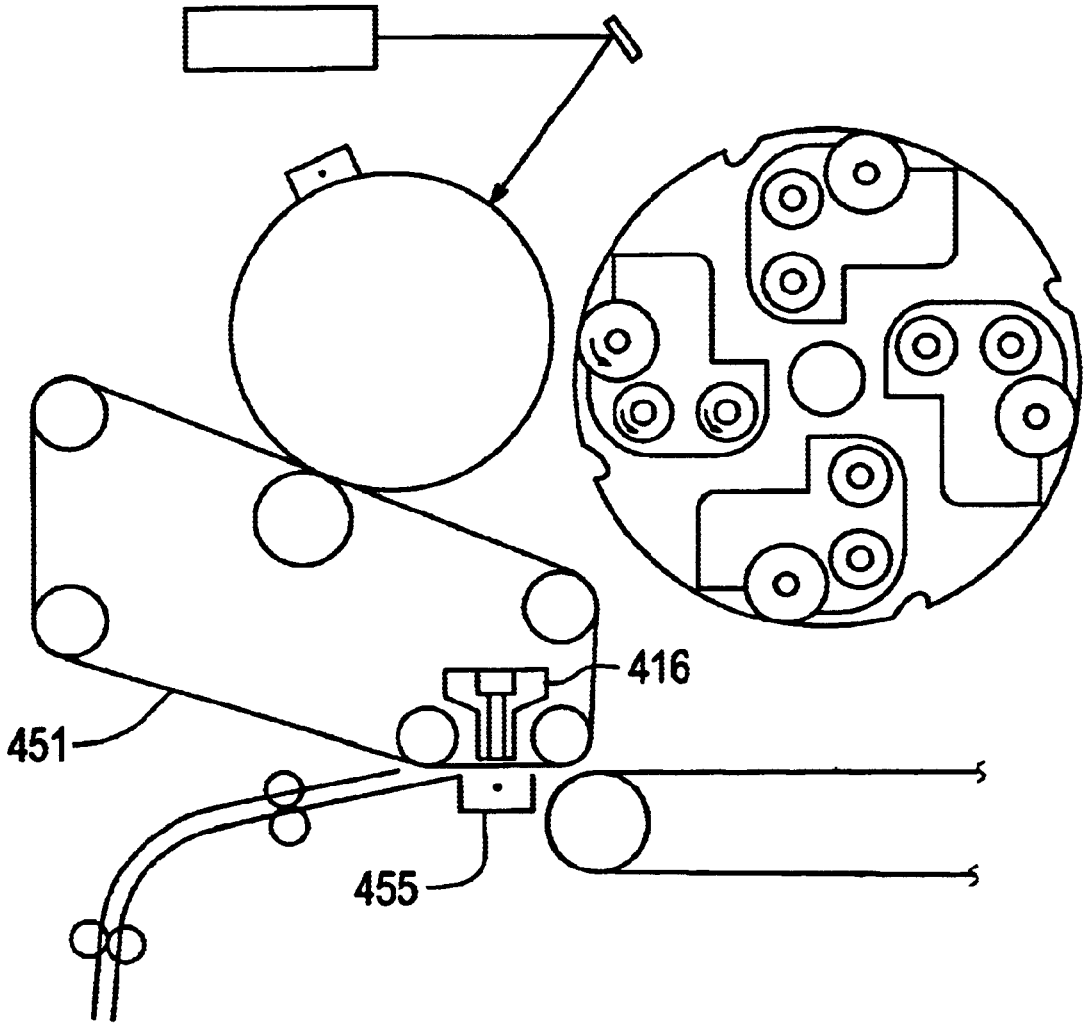
FIG. 11 is a view schematically showing an image recording apparatus which is a modification of the apparatus of FIG. 10.

In the image recording apparatus, the fine particles is transferred from the developing unit 405 to the image carrier 401, and part of the transferred fine particles are transferred to the intermediate image transfer belt 411, to thereby form a fine particle layer on the intermediate image transfer belt 411. Accordingly, the image transfer ratio of the toner image from the intermediate image transfer belt 411 to the paper is improved. If the fine particle layer is unsatisfactory for the transferring of the toner image, the second transfer roll 415 may be substituted by a structure including a corotron charger 455, an ultrasonic generator 416, and the like as shown in FIG. 11 The ultrasonic generator 416, located behind the intermediate image transfer belt 411, project an ultrasonic wave onto the Intermediate image transfer belt 411. With tho ultrasonic wave, the toner particles are vibrated to reduce the adhesion of them to the surface of the intermediate image transfer belt 411 and hence to improve the image transfer rate.

Fifth Embodiment

Figure 12:
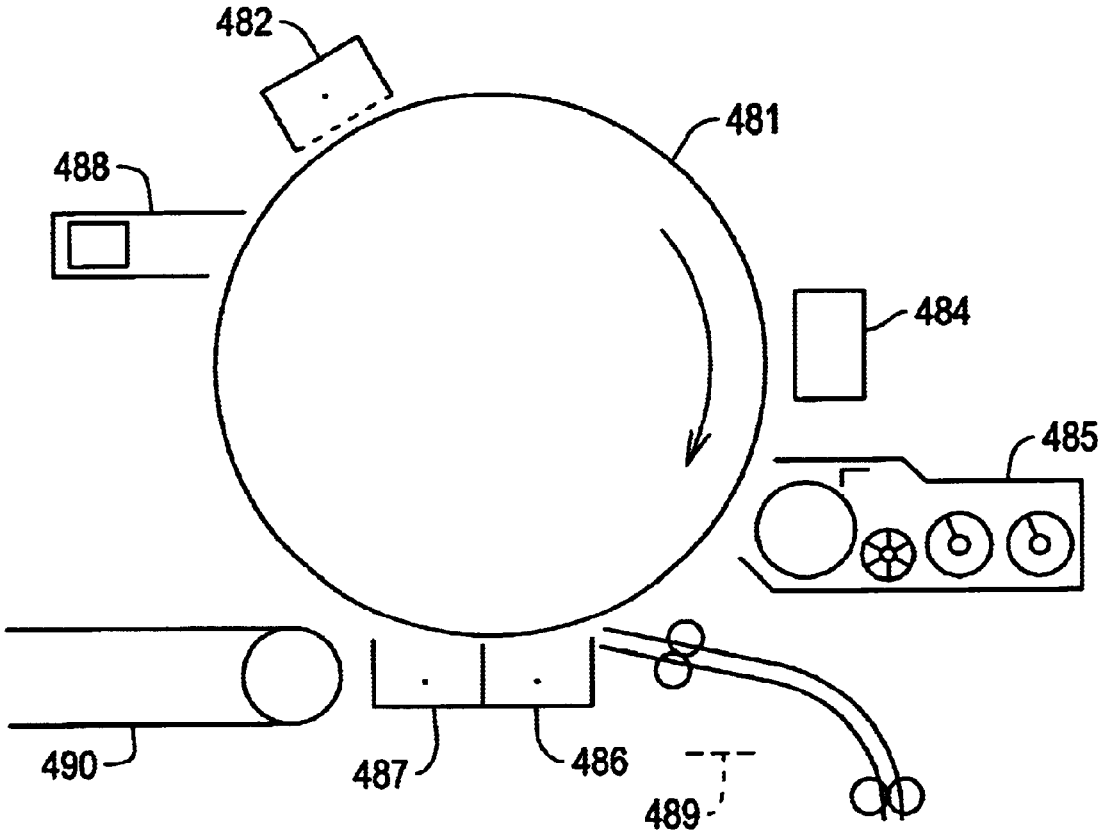
FIG. 12 is a view schematically showing an image recording apparatus according to a fifth embodiment of the present invention.

An image recording apparatus according to a fifth embodiment of the present invention will be described with reference to FIG. 12.

The image recording apparatus of the present embodiment, like the apparatus of FIG. 8A, is not provided with an independent particle supplying unit, and the function of the particle supplying unit is incorporated into a developing unit 485.

The remaining construction of the image recording apparatus, which includes an image carrier 481, a charging unit 482, an image writing unit 484, a transfer charging unit 486, a paper stripping charging unit 487, a paper guide 489, and a paper transporting belt 490, is substantially the same as of the FIG. 1 apparatus.

The developing unit 485 has substantially the same construction as used in the FIG. 1, 5 or 8 apparatus. The developing agent used by the developing unit contains fine particles, which are prepared in a manner that titanium oxide particles of 20 nm in average particle diameter Is treated, by decyl silane, to be hydrophobic. The fine particles are additively contained so that the covering ratio of the fine particles to the surface area of each toner particle is 40%.

The toner and the carrier used in the developing unit are the acme as used in the developing unit of the FIG. 1 apparatus.

Fine particles of the titanium oxide treated for hydrophobicity are uniformly layered in advance on the surface of the image carrier 481. The amount of the fine particles adhering to the image carrier is approximately 15% in terms of an area ratio of the circumferential outer surface of the image carrier. The term "area ratio" means a ratio of an area projected by fine particles to a unit area on the image carrier.

The fine particles adhering to the surface of the image carrier 481 are the same as the fine particles contained in the developing agent. Those particles are surface treated using decyl silane as a treatment for hydrophobicity, so that the fine particles are present in a state that those are loosely agglomerated. Accordingly, those particles are relatively easily dispersed.

Figure 6:
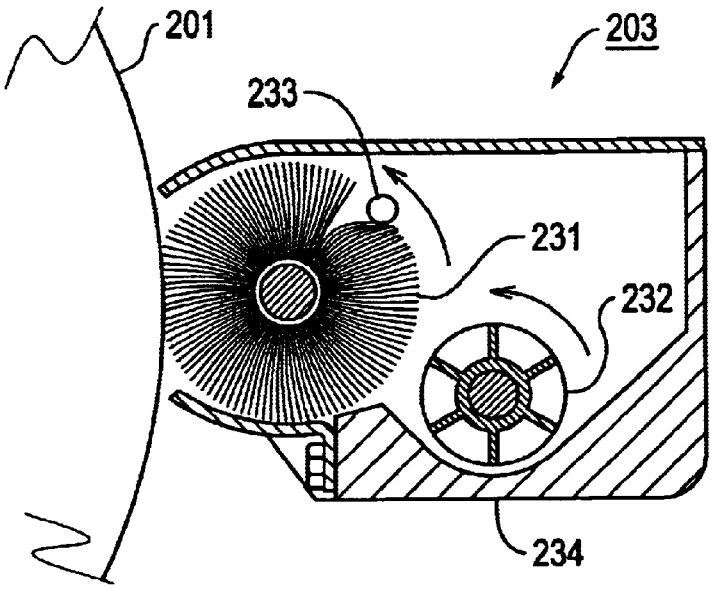
FIG. 6 is a sectional view schematically showing a particle supplying unit used for the image recording apparatus of FIG. 5.

The fine particles may be applied to the image carrier 481 in various ways. In one of the possible ways, the image forming operation is repeated before the image recording apparatus is first used. Through the image forming operations, the fine particles are transferred, together with the toner particles, from the developing unit 485 to the image carrier 481. In another way to apply the fine particles to the image carrier, before the image carrier 481 is assembled into the apparatus body, the fine particles are supplied to the surface of the image carrier, from the device as shown in FIG. 6 or 7.

Titanium oxide, alone of all other materials, is used for the fine particles to be applied to the image carrier 481. Some reasons for this are present. Since titanium oxide has been used as an additive (charge control agent), it is highly reliable. Titanium oxide may be used as an additive to the toner. In the case of the toner already containing titanium oxide, the particles separated from the toner are supplied to the image carrier, to thereby maintain the presence of the fine particles on the surface of the image carrier. The volume resistivity of titanium oxide is lower than that of any of other materials widely used. Further, it has a high dielectric constant.

A volume resistivity of the fine particles is $2.5\times10^{12}$ Ωcm, and is measured in the following manner.

The fine particles are packed into a cylindrical container of 10 mm in diameter, and tapped. A conductive member Is put on the fine particles packed and a load of 9.8 N/cm$^2$ is applied to the conductive member. A voltage is applied to between the conductive member and the bottom electrode so as to generate an electric field of 1 kV/cm. Under the application of the voltage, a current value is measured.

Inorganic materials exhibiting semiconductive or dielectric nature, such as zinc oxide, tin oxide, titanic acid barium, and titanic acid strontium, may be used for the fine particles, in addition to titanium oxide. The materials for the fine particles are not limited to those referred to above, if their dielectric constant is relatively high and their volume resistivity is within the range from $1\times10^{8}$ Ωcm to $1\times10^{14}$ Ωcm.

To secure an environmental stability, it is desirable that the fine particles are less hygroscopic. Those materials including titanium oxide are hygroscopic. If any of those materials are used for the fine particles, it must be treated so as to have a hydrophobic property. A silane coupling agent, such as hexamethyl-disilane, dimethyldichlorosilane, dialkyldihalogenosilane, trialkylhalogenosilane, or alkyltrihalogenosilane, or an agent for hydrophobicity, for example, dimethylsilicone oil, may be used for treating the inorganic fine particles for hydrophobicity, in addition to decylsilane. In this case, the fine particles are made react with any of those materials at high temperature.

In case where the light-interruption effect already referred to must specially be taken into account to secure a satisfactory picture quality, the average particle diameter of the fine particles is preferably selected to be the half of the wavelength of light emitted from the exposure light source or shorter (LED: approximately 660 nm, and the semiconductor laser: approximately 780 nm). Ideally, it is 100 nm or shorter.

No problem arises if one or a plural kinds of fine particles are present between the toner and the image carrier 481. What is essential is that the particles intervene between the toner and the image carrier and can reduce the adhesion acting therebetween.

The operation of the thus constructed image recording apparatus will be described.

At the start of an image forming process, the image carrier 481 is driven to turn. With the turn of the image carrier, the surface of it is uniformly charged. At this time, the fine particles of titanium oxide are uniformly layered on the surface of the image carrier. However, those are little charged since their volume resistivity is low. The charged surface of the image carrier is moved to a location where it faces the image writing unit 484, and exposed to image light. At this time, the fine particles adhering to the surface of the image carrier 481 do not interrupt the image light since their average particle diameter is 20 nm and considerably shorter than the wavelength 660 nm of the image light. Accordingly, the charge in the photosensitive layer on the image carrier 481 is reduced in accordance with the image information contained in the image light received, so that an electrostatic latent image is formed defined by potential differences thus caused.

An operation of the image recording apparatus thus constructed will be described.

The electrostatic latent image is moved to a location where it faces the developing unit 485. At this location, the developing roll applies toner particles onto the electrostatic latent image, so that the latent image is visualized into a toner image. The same fine particles as those adhering to the surface of the image carrier have been added to the toner, and the toner particles are transferred, together with the fine particles, to the image carrier. At this time, the transferred fine particles make up a deficiency of the toner particles. The toner image thus formed then is transferred to the recording paper by the transfer charging unit 486. It is noted here that the toner particles lie on the image carrier 481 with the fine particle layer intervening therebetween. Accordingly, the adhesion of them by the nonelectric force, e.g., Van der Waals force, Is weak, and hence the toner image to easily be separated from the surface of the image carrier at a high image transfer rate, and recorded on the paper. At this time, the charge quantity of the fine particles is small, and a Van der Waals force more intensively acts on the finer particles than an electrostatic Coulomb attraction, and adhere to the surface of the image carrier by the Van der Waals attraction. Therefore, a reduced number of fine particles are transferred, together with the toner particles.

After the toner image is thus transferred onto the recording paper, the fine particles are still left on the surface of the image carrier. In this state, the next step of the image forming process is executed since the cleaning unit is not used in the Image recording apparatus.

If the image transfer ratio is 100%, no fine particles should be left on the image carrier. Actually, the fine particles, although their amount is slight, are often left, however. Even in such a case, most of the fine particles are collected by the developing unit in the next image forming process step.

Experiments for evaluating the image transfer characteristic and the characteristic maintenance of the image recording apparatus will be described.

<<Experiment on Image Transfer Characteristic>>

In the experiment, the image transfer ratio were measured by varying an adhering state of the fine particles on the image carrier. Five states of different amounts of fine particles adhering onto the surface of the image carrier were set up. The area ratio (ratio of an area projected by fine particles to a unit area on the image carrier) and the image transfer ratio were measured on those states. An image analyzing instrument (LUZE XIII, manufactured by NIKORE co. in Japan) was used for measuring the area ratios. In the measurement, a portion having the fine particles adhering thereto and a portion not having fine particles are demarcated by color.

The fine particles were applied to the image carrier by using the particle supplying unit of FIG. 6 before the image carrier was assembled into the apparatus body.

The following method was employed to apply the fine particles.

The image carrier 481 was rotated at a fixed speed. In this state, the rotary brush was turned so that the tips of the brush move in the same direction while being in contact with the surface of the image carrier 481. The speed of the rotary brush was so selected that the brush tips move faster than the periphery of the image carrier 481. An adhesion state was varied by adjusting the amount of fine particles supplied to the rotary brush, from the paddle located behind the rotary brush in the particle supplying unit.

Figure 13:
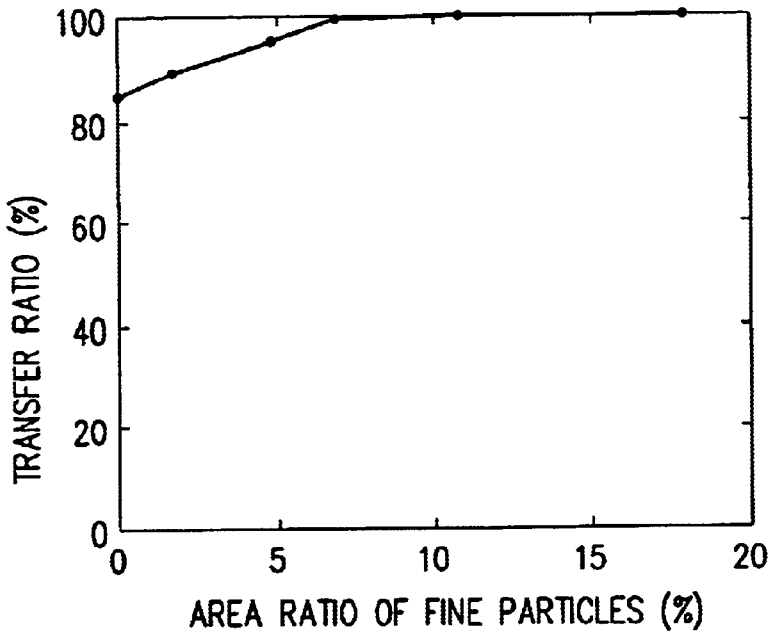
FIG. 13 is a graph showing a variation of an image transfer rate of the fine particles adhering to the circumferential outer surface of the image carrier of the FIG. 12 apparatus with respect to an area ratio of the toner particles formed on the fine particles.

The result of the measurement is shown in FIG. 13. A graph of the figure shows a variation of the image transfer ratio with respect to the area ratio of the fine particles.

As seen from the result, the image transfer ratio increases with increase of the area ratio. When the area ratio is 7 to 8%, the image transfer ratio reaches approximately 100%. In other words, when the area ratio is relatively small, viz., the amount of fine particles adhering to the surface of the image carrier is small, the image transfer ratio fails to reach a target value, 100%.

<<Experiment on Image Transfer ratio Maintenance>

Figure 14:
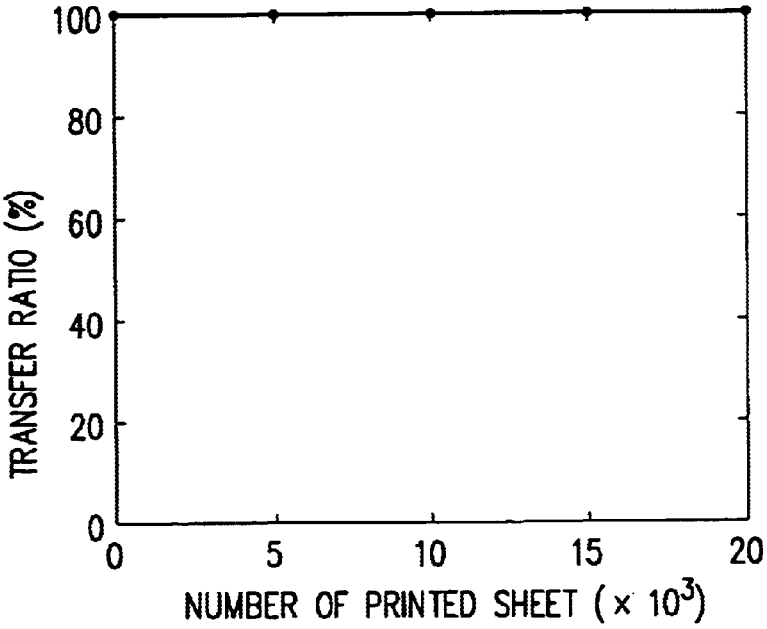
FIG. 14 is a graph showing the result of measuring a variation of an image transfer ratio when 20,000 sheets of images are printed by the FIG. 12 apparatus.

The experiment was conducted to evaluate the image transfer ratio maintenance. The image recording apparatus of the present embodiment was used. Print of 20,000 sheets was made at the image transfer ratio of approximately 100% (area ratio=15%). The image transfer ratio and an image state were adjusted. The result of the experiment is shown in FIG. 14. The experiment result teaches that the initial image transfer rate, viz., approximately 100%, is maintained after the print of 20,000 sheets. Further, a positive ghost that will be formed on the next image by the residual toner was not observed after the print of 20,000 sheets.

Figure 15:
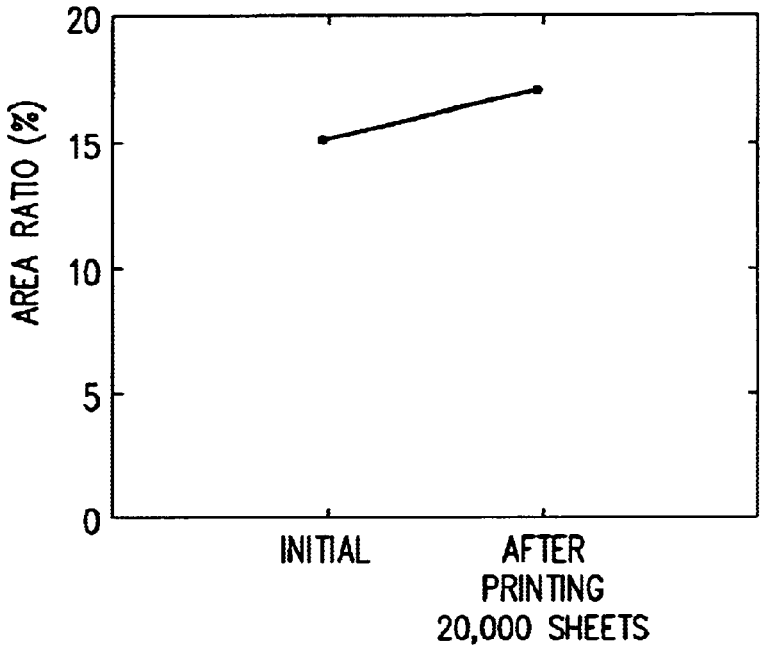
FIG. 15 is a graph showing a variation of an area ratio of the fine particles adhering to the surface of the image carrier in the FIG. 12 apparatus before and after the print of 20,000 sheets.

To check an adhesion state of fine particles on the image carrier, an area ratio of the fine particles on the image carrier was measured after the print of 20,000 sheets. The result of the measurement is as shown in FIG. 15. A graph of the figure shows that the area ratio increases after the print of 20,000 sheets. It is considered that this is due to the fact that the same fine particles as added to the toner are transferred to the image carrier.

Experiment on Particle Material

In this experiment, fine particles of different volume resistivities were used for those added to the developing agent and those adhering to the surface of the image carrier. The image transfer ratio maintenance of those different kinds of fine particles were comparatively measured.

Figure 16:
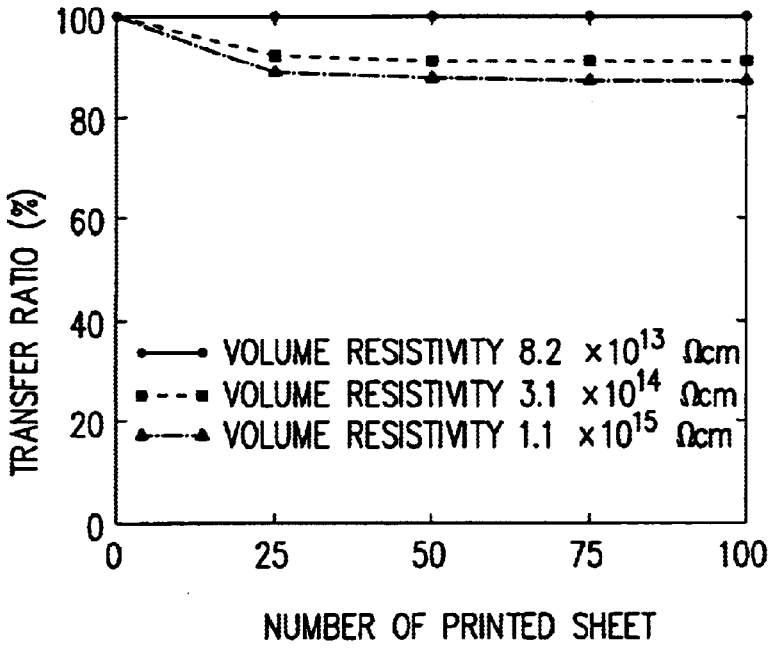
FIG. 16 is a graph showing a variation of an image transfer ratio of the toner image formed on the fine particles adhering to the surface of the image carrier in the FIG. 12 apparatus with respect to the number of prints, with a parameter of the volume resistivity of the fine particles.

In the experiment, the fine particles (made of titanium oxide treated for hydrophobicity) used in the image recording apparatus of the present embodiment were substituted by fine particles samples of different volume resistivities. Those sample particles were made to adhere to the surface of the image carrier as in the manner described above. The same were added to the developing agent. A print test of 100 sheets was conducted. The area ratio of the fine particles adhering to the surface of the image carrier was set at 15% for all the sample particles. The results of the test were as shown in FIG. 16. The image transfer ratio was approximately 100% when their volume resistivity is $8.2\times10^{13}$ Ωcm. A tendency to decrease the image transfer ratio was observed when their volume resistivity is $3.1\times10^{14}$ Ωcm and $1.1\times10^{15}$ Ωcm. The experiment results teach that the volume resistivity must be set to be approximately $1\times10^{14}$ Ωcm or smaller.

Figure 17:
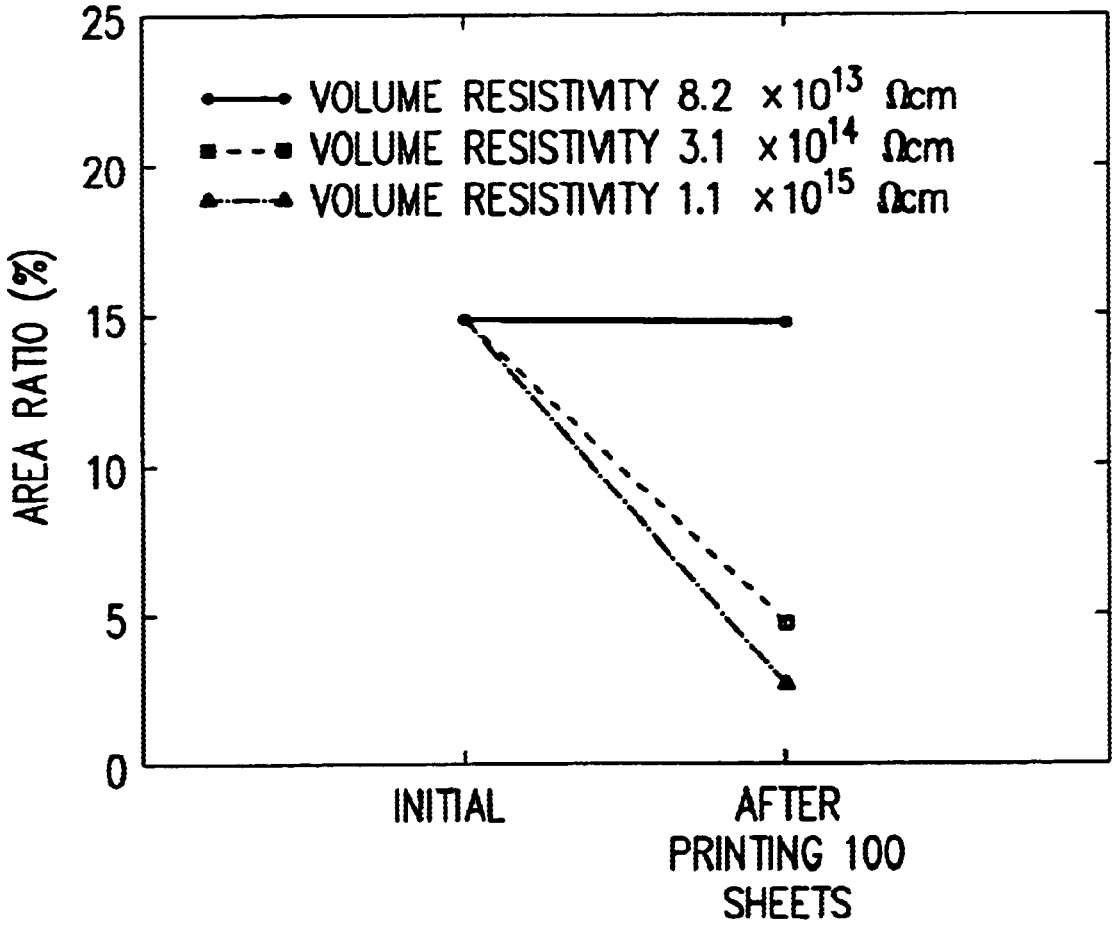
FIG. 17 is a graph showing a variation of an area ratio of the toner image formed on the fine particles adhering to the surface of the image carrier in the FIG. 12 apparatus with respect to the number of prints, with a parameter of the volume resistivity of the fine particles.

To check an adhering state of fine particles on the image carrier after the image formation of 100 sheets, the area ratios of the fine particles on the image carrier after the test were measured. The results of the measurement are as shown in FIG. 17. The area ratio is not varied at $8.2\times10^{12}$ Ωcm of the area ratio, but is decreased when it is $3.1\times10^{13}$ Ωcm and $1.1\times10^{15}$ Ωcm. Therefore, it is considered that the amount reduction of the fine particles adhering to the surface of the image carrier is a cause of the variation of the image transfer ratio in FIG. 16.

To check the charging characteristic of the fine particles used in the above experiment, the following experiment was conducted using the image recording apparatus described above. Those different kinds of fine particles were made to adhere to the surface of the image carrier so that the area ratio is 15%. After undergoing the charging process, the charge degrees of the charged fine particles were evaluated. To this end, immediately after the charging process ends, the image recording apparatus was stopped, and the image carrier was pulled out of the apparatus body. The Image carrier was exposed to natural light, to sufficiently reduce the surface potential. Then, the surface potential of the image carrier was measured. With this, the potential of the charged fine particles was measured and the charging characteristic of the fine particles could be evaluated. For the measurement of the surface potential, the surface potentiometer, Model 1344, manufactured by TREK corporation was used.

The results of the experiment are as shown in Table 1.

TABLE 1

| Volume resistivity (Ωcm) | Potential of charged particles after charging process ends (V) |
|---|---|
| $8.2\times10^{13}$ | −1 to −3 |
| $3.1\times10^{14}$ | −21 to −187 |
| $1.1\times10^{15}$ | −27 to −226 |

As seen from the table, the fine particles are a little charged when their volume resistivity is $8.2\times10^{13}$, but are negatively charged when their volume resistivity is $3.1\times10^{14}$ and $1.1\times10^{15}$.

In the image recording apparatus of the present embodiment, the negatively charged fine particles are put in a positive electric field in the image transferring process, and part of the fine particles are transferred together with the toner particles by the Coulomb attraction. Therefore, it is considered that the difference of the amounts of the fine particles adhering to the surface of the image carrier is caused by the charging characteristic of the fine particles. As seen from Table 1, no extra charging takes place in the fine particles if their volume resistivity is low, approximately $1\times10^{14}$ Ωcm or smaller. Accordingly, the particles will not be transferred from the surface of the image carrier by the Coulomb attraction. This ensures a high image transfer rate.

In this connection, when the volume resistivity of the fine particles is low, the charge on the surface of the image carrier moves laterally, viz., flows along the surface of the image carrier. If the lateral flow of the charge occurs, the demarcation of the electrostatic latent image defined by the potential differences is unclear. The resultant image gets blurred (this phenomenon is called "deletion"). Therefore, the lower limit of the volume resistivity of the fine particles is determined by a tolerable degree of the blur of the image caused by the lateral flow of the charge. Our experiment conducted using the image recording apparatus of the embodiment showed that the volume resistivity of $1\times1^{8}$ Ωcm or larger was allowed.

As seen from the above experiments, the volume resistivity of the fine particles is preferably within the range from $1\times10^{8}$ Ωcm to $1\times_{10}{}^{14}$ Ωcm.

Sixth Embodiment

Figure 18:
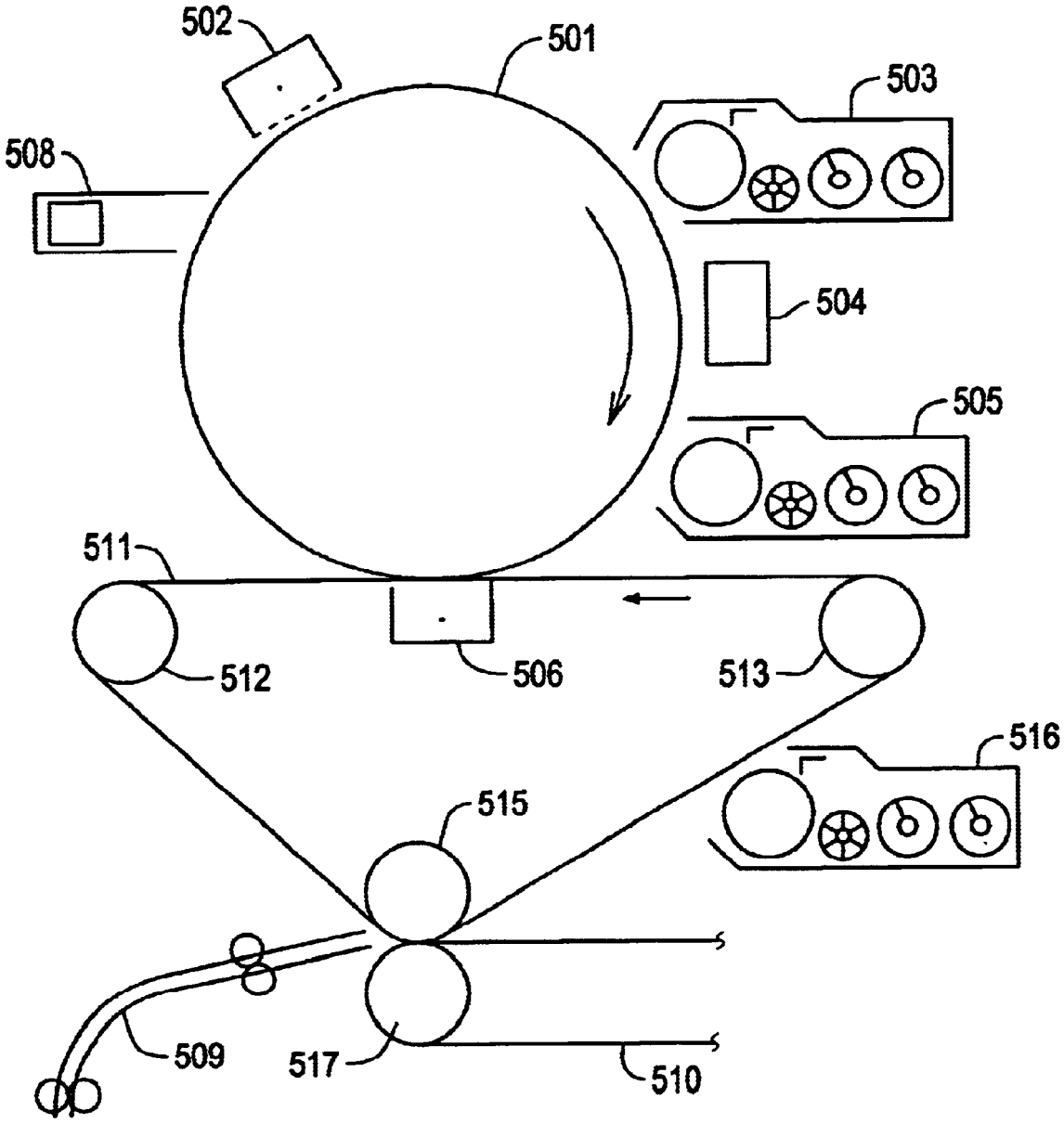
FIG. 18 is a view schematically showing an image recording apparatus according to a sixth embodiment of the present invention.

An image recording apparatus according to a sixth embodiment of the present invention will be described with reference to FIG. 18.

The image recording apparatus of the sixth embodiment is made up of an image carrier 501, a charging unit 502, a particle supplying unit 503, an image writing unit 504, a developing unit 505, and a charge-removal exposure unit 508, till of those devices being substantially the same as of the FIG. 1 apparate. The image recording apparatus further includes an intermediate image transfer belt 511 rotatably stretched around a plural number of rolls, a transfer charging unit 506 for transferring a toner image from the image carrier 501 to the intermediate image transfer belt 511, and a second particle supplying unit 516 for uniformly transferring fine particles of which the particle diameter is smaller than that of the toner particles.

The second particle supplying unit 516 is the same as used in the FIG. 1 apparatus, and contains a mixture of fine particles made of polymethyl methacrylate of 40 nm in average particle diameter and carrier particles.

An image transferring bias voltage is applied to between the transfer roll 515 and a roll 517 disposed in opposition to the former. A recording paper and the intermediate image transfer belt 511 are put at the nip between those rolls 515 and 517, to transfer a toner image from the intermediate image transfer belt 511 to the paper.

The operation of the image recording apparatus thus constructed will be described. This will constitute an embodiment of the invention.

The image carrier is driven to turn. With the turn, an image forming process is carried out which includes a step of uniformly charging the surface of the image carrier 501, a step of supplying fine particles to the image carrier, a step of forming an electrostatic latent image, a step of developing the latent image with toner supplied, and a toner image formed is transferred onto the intermediate image transfer belt 511 by the transfer charging unit 506.

Before the image forming process is carried out, fine particles are uniformly layered on the surface of the intermediate image transfer belt 511 by the second particle supplying unit 516. Accordingly, the toner image is formed on the fine particles layer on the image carrier, and this ensures a high toner image transfer rate.

The toner image on the intermediate image transfer belt 511 is led to the nip between the paired rolls 515 and 517, and transferred to the paper. At this time, the toner image is highly efficiently transferred since it is layered on the fine particles layer.

Figure 19:
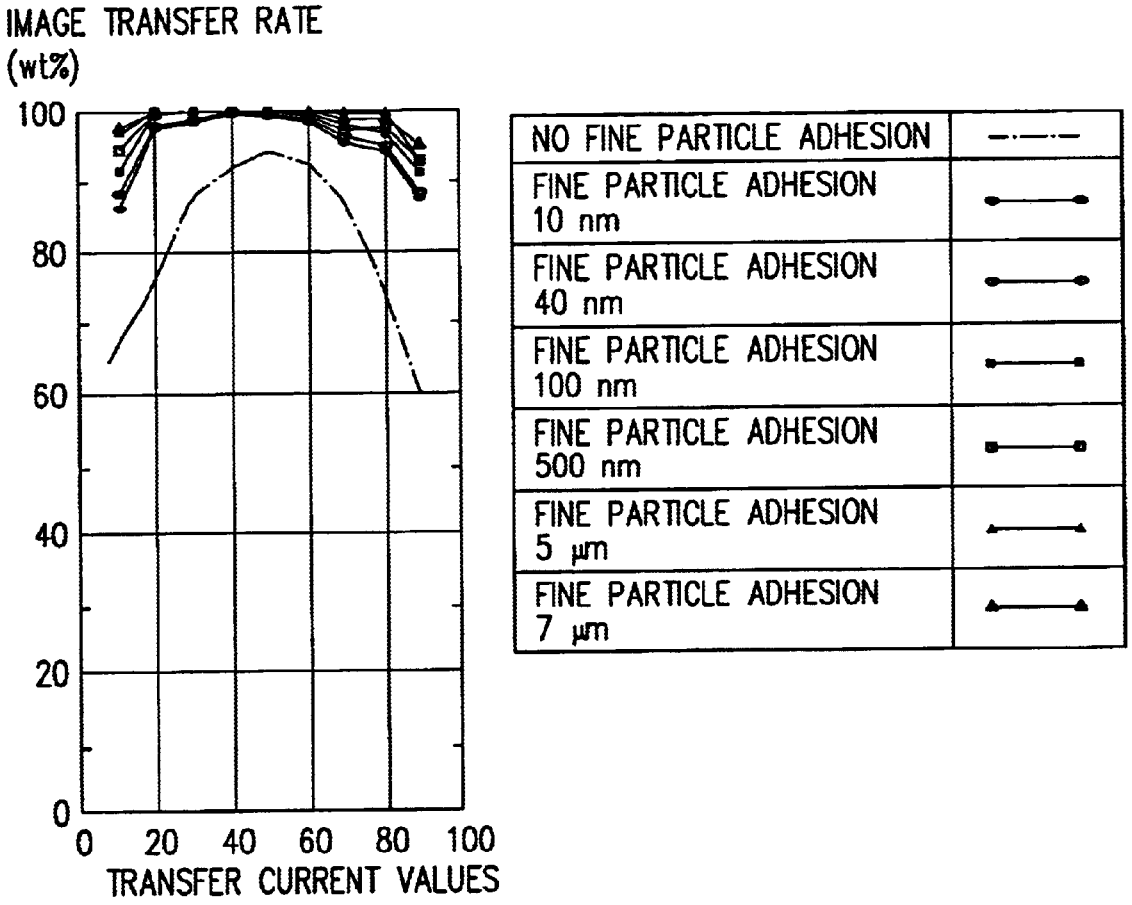
FIG. 19 is a graph showing a variation of an image transfer ratio with respect to a transfer current when a toner image is transferred from an intermediate image transfer belt of the FIG. 17 apparatus to a recording paper.

FIG. 19 is a graph showing the results of an experiment for evaluating the image transferring characteristic of the image recording apparatus of the present embodiment.

In the experiment, a voltage was applied to the transfer roll 515 of the apparatus. A transfer current was varied by controlling the applied voltage. An image transfer ratio was measured when the toner image is transferred from the intermediate image transfer belt 511 to the recording paper. Powdery particles used by the second particle supplying unit 516 were made of polymethyl methacrylate and the average particle diameters of them were 40 nm, 10 nm, 100 nm, 50 nm, 5 $\mu$m, and 7 $\mu$m. To confirm the useful effects of the invention, the image transfer ratio was measured in a state that the particle supplying unit is not operated.

As seen from the graph, the image transfer ratio of the toner image is remarkably improved by forming the fine particle layer on the intermediate image transfer belt 511 before the toner image formation, and if the transfer current value is selected so as to fall within a proper range of the current values (approximately 40 $\mu$A to 50 $\mu$A in the image recording apparatus of the embodiment), the image transfer ratio reaches about 100%. It was observed that the image transfer ratio increased with increase of the particle diameter of the powdery particles, but the increase of the image transfer ratio was negligible. From the evaluation of the picture quality, it was seen that the particle diameter of the powdery particles is preferably 5 $\mu$m or shorter, as in the FIG. 1 apparatus.

Seventh Embodiment

Figure 20:
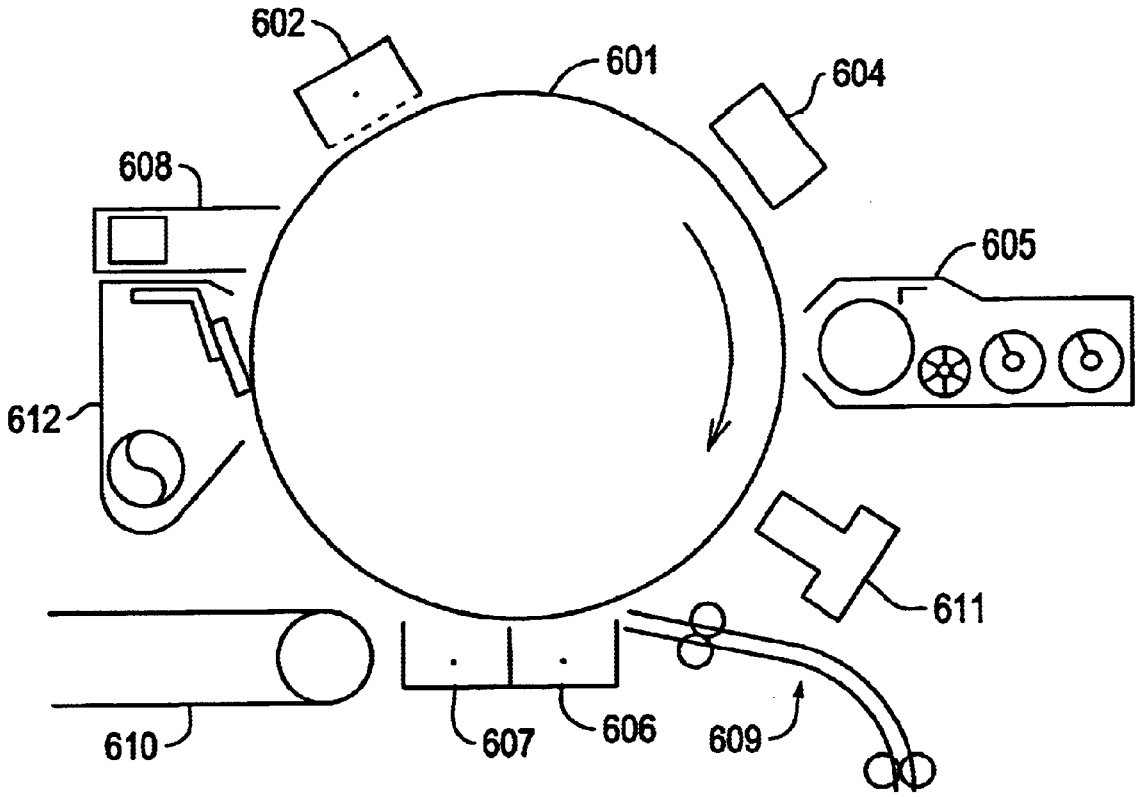
FIG. 20 is a view schematically showing an image recording apparatus according to seventh embodiment of the present invention.

An image recording apparatus according to a seventh embodiment of the present invention will be described with reference to FIG. 20.

The image recording apparatus of the seventh embodiment is made up of an image carrier 601, a charging unit 602, an image writing unit 604, a developing unit 605, and a transfer charging unit 606, a paper stripping charging unit 607, and a charge-removal exposure unit 608, all of those devices being substantially the same as of the FIG. 1 apparatus. The image recording apparatus further includes an ultrasonic generator 611 located facing both end portions thereof where no image is to be formed. The ultrasonic generator 611 projects an ultrasonic wave at 70 kHz to the image carrier.

The image recording apparatus is provided with a cleaning unit 612 having a blade, which is to be brought into contact with the surface of the image carrier 601, and not provided with a particle supplying unit.

In the image recording apparatus thus constructed, the surface of the image carrier 601 is uniformly charged, and an electrostatic latent image is formed on the charged surface of the image carrier by exposing the surface to image light. When the electrostatic latent image is developed with the toner transferred, the toner is pushed against the surface of the image carrier with a magnetic brush consisting of carrier particles chained like ears. In this state, an adhesion by contact intensively acts. During a period from an instant that the toner image passes the developing area till it reaches the image transferring location, an ultrasonic wave is projected to the image carrier 601. The result is to vibrate the surface of the image carrier 601 and the toner particles. During a period from the developing process to the transferring process, mechanical and electrical forces little are exerted on the toner particles. Accordingly, with the vibration, the toner particles are slightly moved with respect to the contact surface and rise to the surface of the image carrier 601. The result is reduction of the adhesion of the toner particles.

In connection with this, a technique to project an ultrasonic wave to the image transferring area is known. In this area, the paper is in close contact with the surface of the image carrier. Accordingly, a force to mechanically hold the toner particles acts, so that an insufficient reduction of the adhesion of the toner particles is secured. On the other hand, in the image recording apparatus of the invention, an ultrasonic wave is projected in a state that the toner particles are free from the force willing to hold the toner particles. Therefore, the adhesion of the toner particles is effectively reduced.

When an electrical force generated by the transfer charging unit 606 acts on the toner particles of which the adhesion is reduced, the toner particles are easily separated from the surface of the image carrier, and transferred onto the paper. Accordingly, the image transfer ratio of the toner image is considerably improved, and a little toner is left after the image transferring process.

Eighth Embodiment

Figure 21:
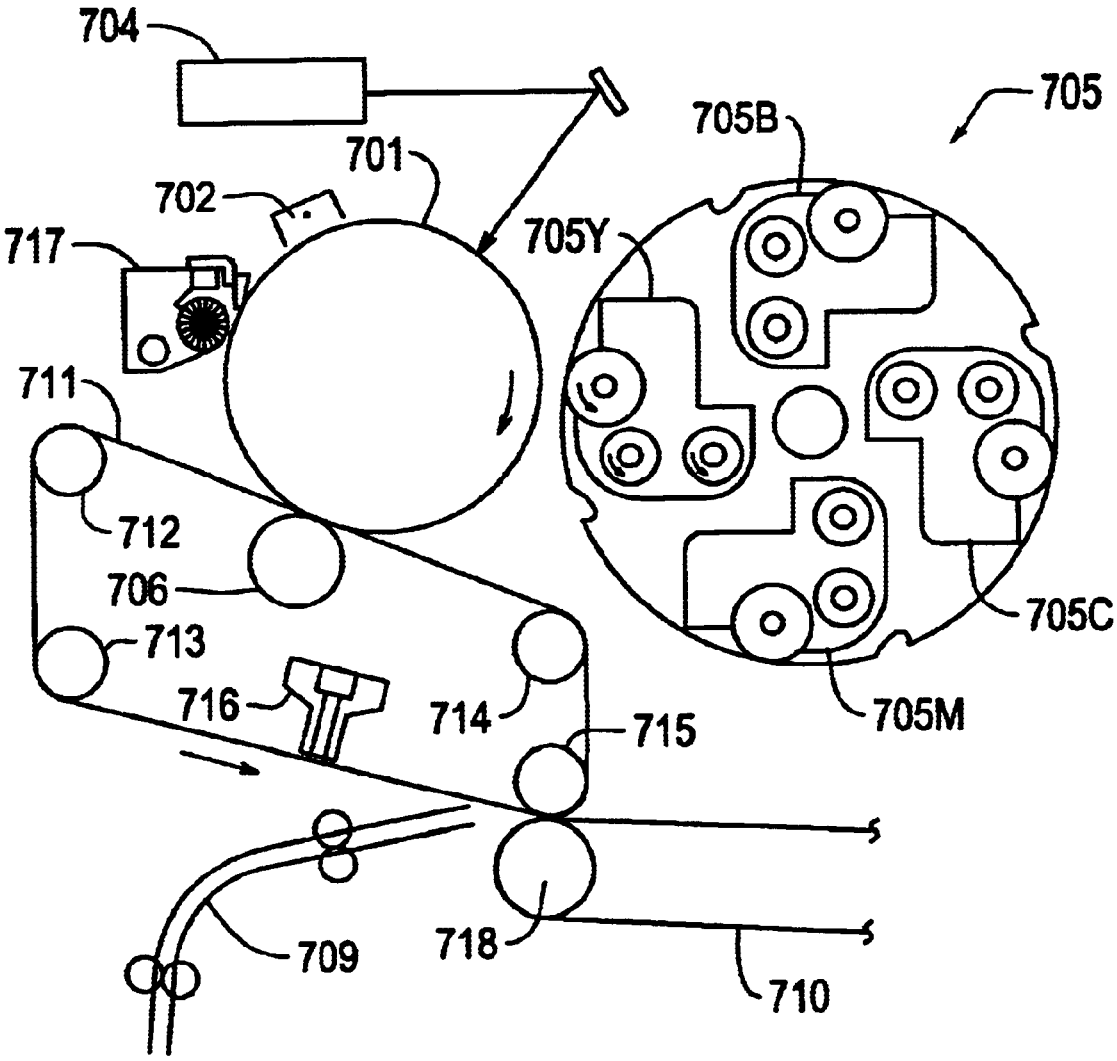
FIG. 21 is a view schematically showing an image recording apparatus according to an eighth embodiment of the present invention.

An image recording apparatus according to an eighth embodiment of the present invention will be described with reference to FIG. 21.

The image recording apparatus of the eighth embodiment is made up of an image carrier 701, a charging unit 702, an image writing unit 704, a developing unit 705, an intermediate image transfer belt 711, a transfer charging unit 706, a paper stripping charging unit 707, and a second transfer roll 715, all of those devices being substantially the same as of the FIG. 10 apparatus. The image recording apparatus further includes a cleaning unit 717 brought into contact with the image carrier 701, and an ultrasonic generator 716 which is located upstream of the second transfer roll 715 while facing the intermediate image transfer belt 711. A developing agent to be contained in the developing unit uses the same toner and carrier am used in the FIG. 10 apparatus. As for an additive, fine particles of titanium oxide is added to the developing agent so that a covering ratio of the fine particles to the surface area of the toner particle is 30%.

The image recording apparatus thus constructed repeatedly performs a sequence of operations of uniformly charging the surface of the image carrier 701, forming an electrostatic latent image by the exposure, developing the latent image with toner into a toner image, transferring the toner image on the intermediate image transfer belt 711, and cleaning the image carrier 701 after the transferring of the toner image, for four colors, yellow, magenta, cyan, and black. The toner images of those colors are superposedly transferred onto the intermediate image transfer belt 711. In the image transferring process, the toner images are pressed against the intermediate image transfer belt 711 by the transfer charging unit 706. At this time, the toner image of the lowermost layer is put in a state that it is difficult to be transferred. The thus superposed toner images are carried on the intermediate image transfer belt 711 to a location where the images are transferred onto a recording paper. Before the images reaches that location, the intermediate image transfer belt 711 and the toner particles of those images carried thereon are vibrated by an ultrasonic wave projected from the ultrasonic generator 716. At this time, the toner particles rise to the surface of the intermediate image transfer belt 711 since those particles are not retrained by any mechanical and electrical force. As a result, the adhesion of the fine particles is reduced. Accordingly, the toner images are easily separated from the intermediate image transfer belt 711 and transferred onto the paper highly efficiently.

Ninth Embodiment

An image recording apparatus according to a ninth embodiment of the present invention will be described with reference to FIGS. 22A to 22C.

The image recording apparatus of the ninth embodiment is made up of an image carrier 801, a charging unit 802, an image writing unit 804, a developing unit 805, a transfer charging unit 806, a paper stripping charging unit 807, and a charge-removal lamp 808, all of those devices being substantially the same as of the FIG. 1 apparatus. In this image recording apparatus, the settings including the bias voltage in the developing unit 805 are different from those in the FIG. 1 apparatus. Specifically, the DC component of the bias voltage applied to the developing roll is set at −400 V. The gap between the toner thickness control member and the developing roll is set at 0.7 mm. Accordingly, the particle ears of the magnetic brush are high.

The image recording apparatus thus constructed, like the FIG. 1 apparatus, performs a sequence of operations of uniformly charging the surface of the image carrier 801, forming a fine particles layer, writing an image, and developing the written image. The toner image is transferred onto a recording paper fed along a paper guide 809 at high image transfer rate. The toner that is left on the surface of the image carrier having undergone the image transferring process is left as it is or not removed from the image carrier. The surface of the image carrier, which bears the residual toner thereon, undergoes an exposure by the charge-removal lamp and is subjected to the next image forming process. At a location where it faces a particle supplying unit 803, the supplying unit supplies new fine particles to the surface of the image carrier, to thereby make up a deficiency of the fine particles, or the fine particles lost in the preceding transferring process. At this time, the residual toner is still left on the fine particles layer, as shown In FIG. 22B.

The toner particles that are left on the background of a new electrostatic latent image after the image writing, are pulled toward the developing roll in an electric field defined by the background potential (−550 V) and the developing bias voltage (DC: −400 V), as shown in FIG. 22*c*, and scratched off with the magnetic brush with high ears and collected into the developing unit 805.

In this image recording apparatus, if the transfer current is set at 30 $\mu$A, a faintish image history is left on the surface of the image carrier after the image transferring process. If the image history is weak to such an extent that when it is transferred in the next cycle, it would appear as a positive ghost, the cleaning effect of the developing unit 805 removes the ghost and actually no ghost appears. Thus, the technique to form a fine particles layer before the developing process and the technique to give the cleaning function to the developing unit are combined to provide a unique cleaning system free from a positive ghost.

In the image recording apparatus, the charge-removal exposure unit 808 has the cleaning function. Alternatively, the cleaning function may be incorporated into the particle supplying unit 803 having a similar construction. In the alteration, the gap between the layer thickness controlling member of the particle supplying unit 803 and the image carrier is set at 0.7 mm, to thereby increase the height or the ears of the carrier particles. The residual toner Is collected by the particle supplying unit 803 as shown in FIG. 23A. Accordingly, if the residual toner is present, it fails to form a positive ghost, and hence the resultant picture is high in quality.

Tenth Embodiment

Figure 24A:
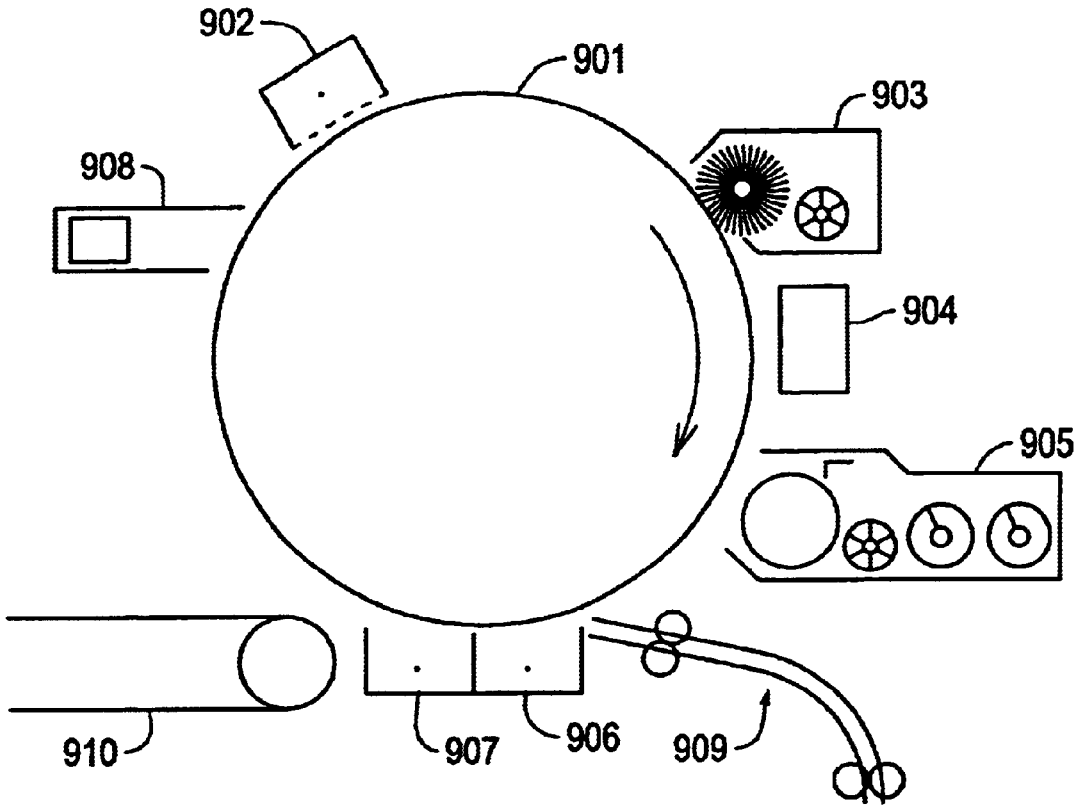
FIGS. 24A and 24D is a view schematically showing an image recording apparatus according to a tenth embodiment of the present invention, the apparatus being arranged such that toner left on the image carrier having undergone the image transferring process is transferred to a recording paper or an intermediate image transfer belt in the next image transferring process.
Figure 24B:
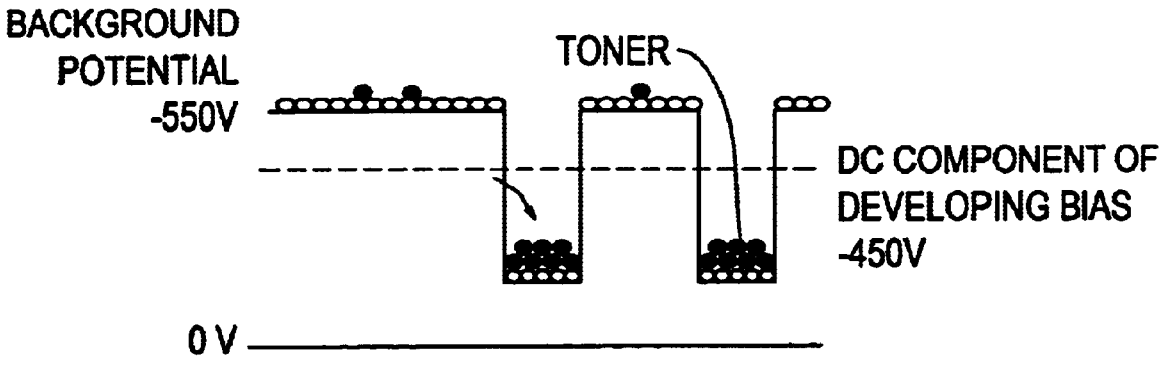

An image recording apparatus according to a tenth embodiment of the present invention will be described with reference to FIGS. 24A and 24B.

The image recording apparatus of the tenth embodiment is made up of an image carrier 901, a charging unit 902, a particle supplying unit 903, an image writing unit 904, a developing unit 905, a transfer charging unit 906, a paper stripping charging unit 907, and a charge-removal lamp 908, all of those devices being substantially the same as of the FIG. 5 apparatus. In this image recording apparatus, the developing agent used by and the settings in the developing unit 905 are different from those in the FIG. 5 apparatus.

In the developing agent used in this image recording apparatus, the carrier contains magnetic powdery particles (average particle diameter 40 $\mu$m) of 70% by weight of resin carrier, and the toner contains silica fine particles (average particle diameter: 15 nm) of 0.7% by weight of polyester toner of 7 $\mu$m in average particle diameter, and silica fine particles (average particle diameter: 40 nm) of 0.3 wt %. In the developing agent, a covering ratio of the silica fine particles to the toner la set at approximately 60%. The gap between the developing roll and the image carrier is 0.5 mm, and the height of the carrier ears of the magnetic brush is 0.35 mm in the developing area.

The developing bias voltage is formed by superposing an AC voltage of 5 kvp-p and at 5 kHz to a DC voltage of −450 V.

As known, under this condition, for the development, toner particles unidirectionally fly between the image carrier 901 and the tips of the carrier ears of the magnetic brush, and do not take a reciprocal motion therebetween. In other words, under this condition, toner particles on the image carrier 901 are not collected by the developing unit 905.

The image recording apparatus thus constructed, like the FIG. 5 apparatus, performs a sequence of operations of uniformly charging the surface of the image carrier 801, forming a fine particles layer, writing an image, and developing the written image. The toner image is transferred onto a recording paper fed along a paper guide 909 at high image transfer rate. The toner that is left on the surface of the image carrier 901 having undergone the image transferring process is left as it is or not removed from the image carrier. The surface of the image carrier, which bears the residual toner thereon, undergoes an exposure by the charge-removal lamp 908 and is subjected to the next image forming process. In the next image forming process, a fine particle layer is formed, a new electrostatic latent image is formed as shown In FIG. 24B. Even after this, the residual toner is still left on the image carrier 901. The residual toner, together with a new toner image, is transferred onto a recording paper by the transfer charging unit 906.

This image recording apparatus is not provided with a device for collecting the toner left on the image carrier 901 having undergone the image transferring process. Accordingly, the residual toner will be accumulated unless it is transferred in the next and subsequent cycles of the image carrier. Actually, the residual toner is little accumulated, however. The reason for this is that an image transfer ratio of the apparatus is good, and almost perfectly transferred in the next cycle.

An experiment was conducted to examine the accumulation of the residual toner on the image carrier. The results of the experiment will be described below.

Figure 27:
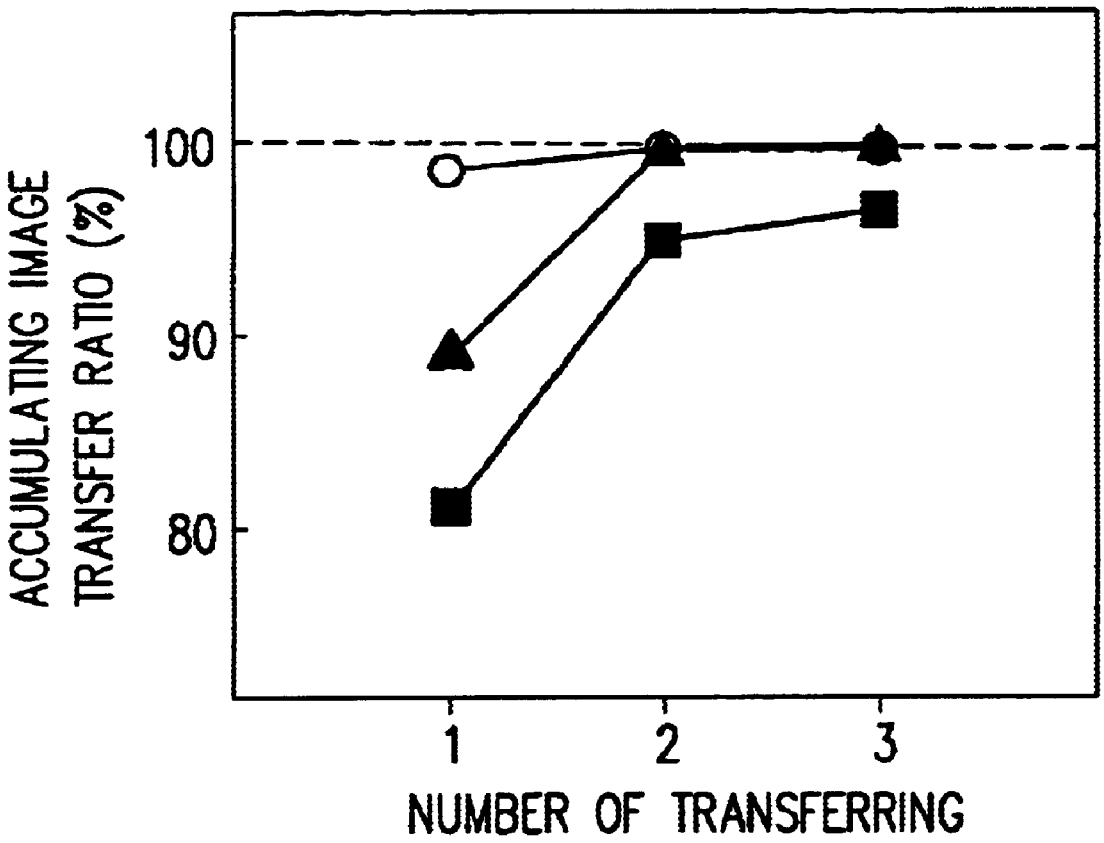
FIG. 27 is a graphical representation of variations of the accumulating image transfer ratio with respect to the number of toner Image transferring.

In the experiment, a reference toner image was formed on the image carrier. The reference toner image was transferred several times at the same image transfer rate. The amount of residual toner was measured every time the reference toner image is transferred. The experiment repeatedly was made at different image transfer rates. The results of the experiments are graphically shown in FIG. 27.

As seen from the graph of rig. 27, when the image transfer ratio is approximately 80%, a slight amount of toner is left after the image transfer is made two or three times. If it is 90% or higher, the toner is little left. The fact teaches that if the transfer current is set at such a value as to provide an image transfer ratio of 90% or higher, the toner accumulation problem can be solved.

Figure 25:
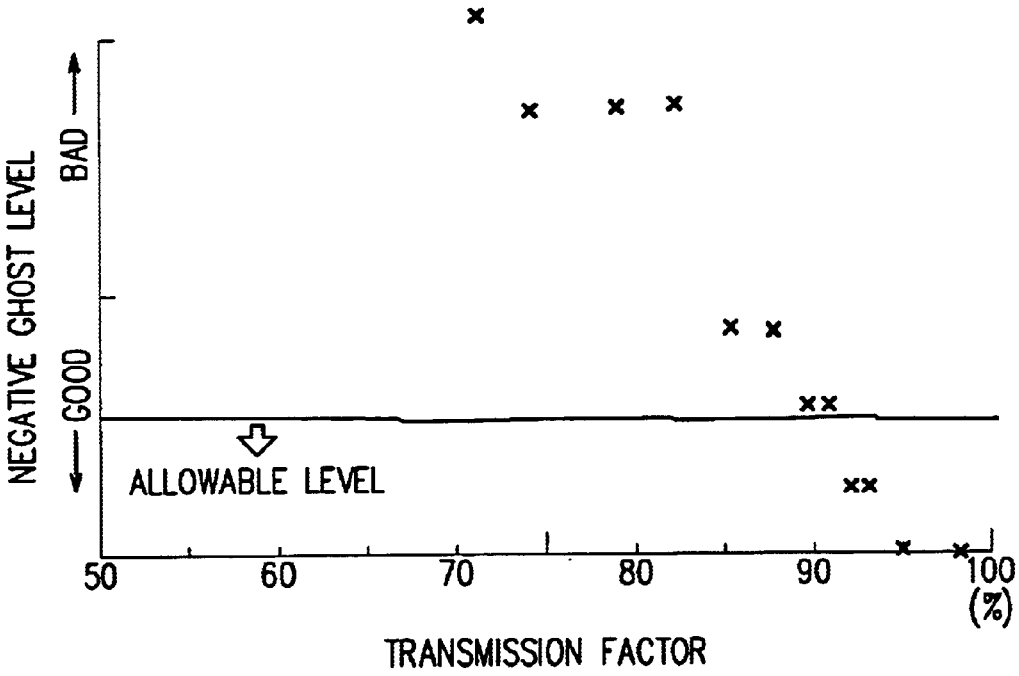
FIG. 25 is a graphical representation of variations of levels of formed negative ghost with respect to the transmission factor of image light.
Figure 26:
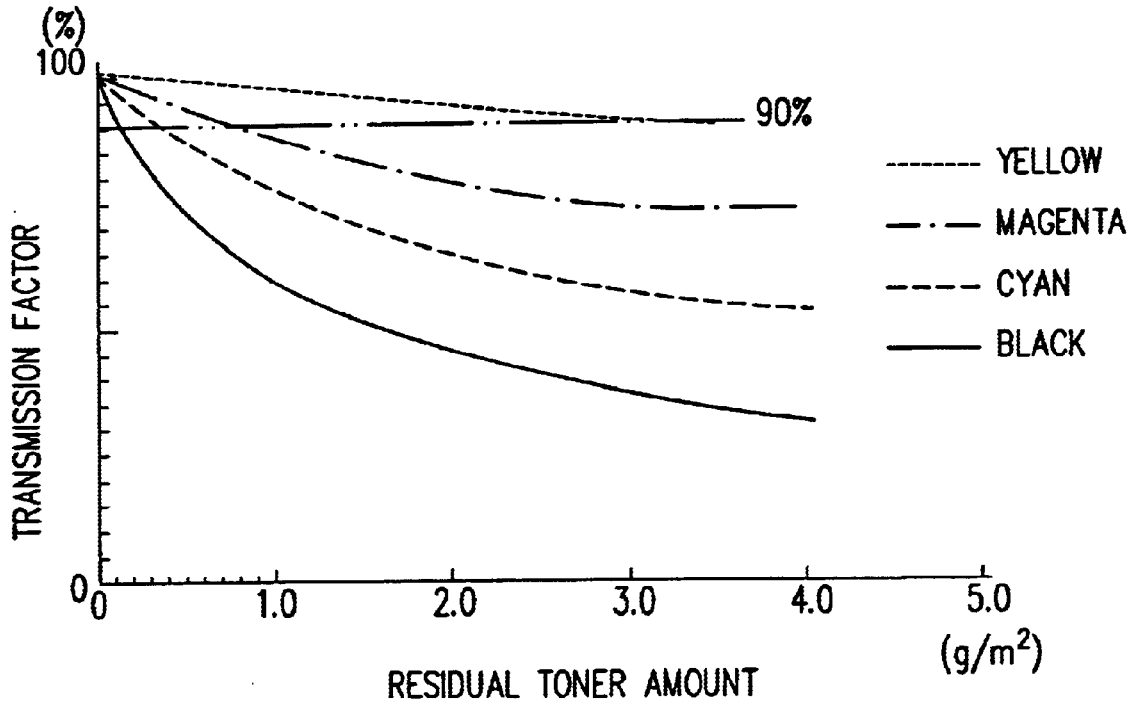
FIG. 26 in a graphical representation of variations of the transmission factor of image light with respect to the amount of residual toner.

The image recording apparatus of the embodiment is designed such that a transmission factor of 90% or higher is secured for image light if toner is left after the image transferring process. This is really the condition to prevent a called negative ghost from occurring, and based on the data shown in FIG. 25. Levels of formed negative ghost were measured while varying the transmission factor of image light, and the results of the measurement were plotted in FIG. 25. As seen from the graph, the negative ghost, viz., the ghost formed when image light is interrupted by the residual toner, falls within tolerable levels when the transmission factor is 90% or higher. Generally, as the residual toner amount Increases, the transmission factor decreases. The toner-amount vs. transmission-factor characteristic depends largely on kinds of toner used, as shown in FIG. 26. This fact implies that to effectively prevent the negative ghost, the transmission factor, not the residual toner amount, must be used in designing the image transferring unit.

Thus, the image recording apparatus of the tenth embodiment is free from those problems, the image defects, for example, positive and negative ghosts, and the residual toner accumulation on the image carrier. Further, the toner collection by using the developing unit is not carried out in the image recording apparatus. With this feature, there is no chance that foreign materials, for example, paper particles, are mixed into the developing unit, and hence there is eliminated that troublesome work to periodically replace the developing agent with new one.

The image recording apparatuses thus far described are based on the electrophotographic method by the Carlson process. The invention is applicable to any of the indirect transfer printing apparatuses of the chargeless printing type, the back-exposure type, and the like, which are capable of printing on a print paper. Further, the invention may be used for a printing apparatus of the type in which dielectric is used instead of photosensitive material, and an electrostatic latent image is directly written into a layer, for example, that is made of dielectric material, visualized and transferred to a print sheet. Called electrostatic printing and ionography printing apparatuses, for example, are categorized into this type of the printing apparatus.

As seen from the foregoing description, in indirect-transfer type printing apparatus or method of the present invention, a fine particle layer is uniformly formed on the image carrier before the toner Image formation, and a toner image is formed on the fine particle layer. This unique feature brings about advantages. A first advantage is to considerably improve a toner image transfer rate. A second advantage is to reduce the toner collected from the image carrier having undergone the image transfer process to zero or considerably reduce the same. Another unique feature of the present invention is to apply an ultrasonic wave to some image carrier in the path between the developing stage and the image transferring stage. This feature also considerably contributes to the improvement of the image transfer rate. Still another unique feature of the invention is to select the volume resistivity of the fine particles to be within a specific range of its values. This feature also provides high image transfer rates.

These unique technical features may be applied to the transferring of the toner image from an intermediate image transfer belt to an intermediate printing sheet or an image transfer body, for the purpose of improving the image transfer rate.

An additional unique technical feature of the invention is that the particle supplying unit or the developing unit may have the cleaning function. Accordingly, an image recording apparatus not having the cleaning unit can print a picture not suffering from defects, for example, ghosts. Further, the maintenance of the apparatus is easy since the amount of toner collected is remarkably reduced and the replacement of the developing agent with new one is not required.

A further unique technical feature is that the residual toner is transferred, together with the image next formed, to unit for temporarily or permanently carrying a toner image, viz., the residual toner is not collected. With this feature, an indirect-transfer type image recording apparatus in which toner to be collected and cast is not produced is successfully realized.

What is claimed is:

1. An image recording apparatus, comprising:

image carrying means having a surface on which an electrostatic latent image is formed;

developing means for developing the electrostatic latent image into a toner image by selectively applying toner to the surface of said image carrying means;

image transferring means for transferring the toner image onto a recording sheet or an intermediate image transferring body; and particle supplying means disposed facing the image carrying means, the particle supplying means supplying fine particles to the surface of the image carrying means to form a substantially uniform layer of the fine particles on the surface of the image carrying means, wherein:

the powdery fine particles, having a volume resistivity of between $1\times10^8$ Ωcm and $1\times10^{14}$ Ωcm are uniformly adhneringly formed as an intervening layer on the surface of the image carrying means between the image carrying means and the toner, the particle diameter of the fine particles being smaller than that of the toner, and the toner being transferred among the fine particles on the surface of the image carrying means, and the particle supplying means collects the toner left on the surface of the image carrying means after the surface of the image carrying means passes a location facing the image transferring means.

2. An image recording apparatus according to claim 1, wherein:

said image carrying means has a conductive base electrically grounded and a photosensitive layer formed on said conductive base;

the electrostatic latent image is formed in a manner that the surface of said image carrying means is uniformly charged and exposed to image light; and the fine particles comprises light transmission material.

3. An image recording apparatus according to claim 1, wherein the particle supplying means is a developing device, the developing device containing a developing agent comprising the toner and fine particles of which the particle diameter of the fine particles is smaller than that of the toner, and wherein the particle supply means uniformly supplies the fine particles to the image carrying means before the electrostatic latent image is formed thereon, and the particle supplying means selectively supplies the toner to the electrostatic latent image after the electrostatic latent image is formed thereon.

4. An image recording apparatus according to claim 1, wherein the particle supplying means is a developing device, the developing device containing a developing agent containing toner and fine particles of which the particle diameter of the fine particles is smaller than that of the toner, and wherein the particle supplying means selectively supplies the toner to the latent electrostatic image, while at the same time supplying the fine particles to the image carrying means.

5. An image recording apparatus according to claim 1, wherein a release agent layer formed on the surface of said image carrying means to reduce an adhesion of the surface of said image carrying means to the fine particles formed on said image carrying means.

6. An image recording apparatus according to claim 1, wherein the surface of the fine particles is treated for hydrophobicity.

7. An image recording apparatus according to claim 1, wherein the same fine particles as those adhering to the surface of said image carrying means are applied to the surface of the toner, and the surface of the toner is substantially uniformly covered with the fine particles.

8. An image recording apparatus, comprising:

image carrying means having a surface on which an electrostatic latent image is formed;

developing means for developing the electrostatic latent image into a toner image by selectively applying toner to the surface of the image carrying means;

intermediate transferring means to which the toner image is transferred;

particle supplying means for supplying adheringly fine particles as an intervening layer onto a surface of said intermediate transferring means and the image carrying means between the carrying means and toner to form a substantially uniform layer of fine particles, the fine particles having a volume resistivity of between $1\times10^8$ Ωcm and $1\times10^{14}$ Ωcm and the fine particles having a particle diameter smaller than that of the toner;

image transferring means for transferring the toner image from the intermediate image transferring means onto a recording sheet; supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

9. An image recording apparatus, comprising:

particle supplying means for supplying a uniform layer of adheringly fine particles as an intervening layer onto a surface of an image carrying means between the image carrying means and toner, the fine particles having a volume resistivity between $1\times10^8$ Ωcm and $1\times10^{14}$ Ωcm, the image carrying means surface having formed thereon the fine particles and an electrostatic latent image defined by electrostatic potential differences;

developing means for developing the electrostatic latent image formed into a toner image by selectively applying toner among the fine particles on the surface of the image carrying means;

image transferring means for transferring the toner image onto a recording sheet or an intermediate image transferring means; and ultrasonic wave generating means for projecting an ultrasonic wave to the toner image or the image carrying means without contacting the toner image or the image carrying means before the toner image is transferred from the image carrying means onto the recording sheet or the intermediate image transferring means; wherein:

the particle supplying means is disposed facing the image carrying means, the particle supplying means supplying the fine particles to the surface of the image carrying means to form a substantially uniform layer of the fine particles on the surface of the image carrying means, and the particle supplying means collects the toner left on the surface of the image carrying means after the surface of the image carrying means passes a location facing the image transferring means.

10. An image recording apparatus, comprising:

particle supplying means for supplying a uniform layer of adheringly fine particles as an intervening layer onto a surface of an image carrying means between the image carrying means and toner, the fine particles having a volume resistivity between $1\times10^8$ Ωcm and $1\times10^{14}$ Ωcm, the image carrying means surface having the fine particles and an electrostatic latent image formed thereon;

developing means for developing the electrostatic latent image into a toner image by selectively applying toner among the fine particles on the surface of the image carrying means;

intermediate image transferring means onto which the toner image is transferred;

image transferring means for transferring the toner image from the intermediate image transferring means onto a recording sheet; and ultrasonic wave generating means for projecting an ultrasonic wave to the toner image or the intermediate image transferring means carrying the toner image thereon without contacting the toner image or the intermediate image transferring means after the toner image is transferred from the image carrying means to the intermediate image transferring means but before the toner image is transferred onto the recording sheet or another intermediate image transferring means, wherein:

the particle supplying means is disposed facing the image carrying means, the particle supplying means supplying the fine particles to the surface of the image carrying means to form a substantially uniform layer of the fine particles on the surface of the image carrying means, and the particle supplying means collects the toner left on the surface of the image carrying means after the surface of the image carrying means passes a location facing the image transferring means.

11. An image recording apparatus, comprising:

image carrying means having a surface on which an electrostatic latent image is formed;

developing means for developing the electrostatic latent image into a toner image by selectively applying toner to the surface of the image carrying means;

image transferring means for transferring the toner image onto at least one of a recording sheet and an intermediate image transferring body; and particle supplying means disposed facing the image carrying means, the particle supplying means supplying the fine particles to the surface of the image carrying means to form a substantially uniform layer of the fine particles on the surface of the image carrying means, wherein:

the developing means contains a developing agent comprising the toner and powdery fine particles, the particle diameter of the fine particles being smaller than that of the toner, the developing means uniformly adheringly supplying the fine particles as an intervening layer onto the image carrying means before the electrostatic latent image is formed thereon, and the developing means selectively supplying the toner among the fine particles on the image carrying means after the electrostatic latent image is formed thereon, and the particle supplying means collects the toner left on the surface of the image carrying means after the surface of the image carrying means passes a location facing the image transferring means.

12. An image recording apparatus, comprising:

image carrying means having a surface on which an electrostatic latent image is formed;

developing means for developing the electrostatic latent image into a toner image by selectively applying toner to the surface of the image carrying means;

image transferring means for transferring the toner image onto at least one of a recording sheet and an intermediate image transferring body; and particle supplying means disposed facing the image carrying means, the particle supplying means supplying the fine particles to the surface of the image carrying means to form a substantially uniform layer of the fine particles on the surface of the image carrying means, wherein:

the developing means contains a developing agent comprising the toner and powdery fine particles, the particle diameter of the fine particles being smaller than that of the toner, and the developing means selectively supplying the toner to the image carrying means while at the same time uniformly adheringly supplying the fine particles as an intervening layer onto the image carrying means, and the particle supplying means collects the toner left on the surface of the image carrying means after the surface of the image carrying means passes a location facing the image transferring means.

13. An image recording method, comprising the steps of:

forming an electrostatic latent image defined by electrostatic potential differences on an image carrier having a uniform layer of adheringly fine particles formed on the surface of the image carrier as an intervening layer on a surface of the image carrier between the image carrier and toner, the fine particles having a volume resistivity of between $1\times10^{8}$ Ωcm and $1\times10^{14}$ Ωcm;

forming a toner image by selectively applying toner particles among the layer of the fine particles, the toner particles having a diameter greater than a particle diameter of the fine particles;

transferring the toner image to a recording sheet or an intermediate image transferring unit;

supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

14. An image recording method according to claim 13, wherein, in said step for forming the toner image, the toner, which are not transferred in the preceding transferring step and left in the background portion of a electrostatic latent image, are left on said image carrying means as they are; and in said step for transferring the toner image, the toner left in the background portion are transferred onto a recording sheet or an intermediate image transferring means.

15. An image recording method, comprising the steps of:

forming a substantially uniform layer of light transmissive adheringly fine particles as an intervening layer on a surface of an image carrier between the image carrier and toner, the fine particles having a volume resistivity of between $1\times10^{8}$ Ωcm and $1\times10^{14}$ Ωcm and the surface of the image carrier having a photosensitive layer formed on an electrically grounded base;

substantially uniformly charging the surface of the image carrier;

forming an electrostatic latent image on the image carrier by exposing the layer of fine particles on the surface of the image carrier to image light;

developing the electrostatic latent image into a toner image by selectively applying the toner among the layer of fine particles, the toner having a particle size greater than the particle size of the fine particles;

transferring the toner image onto a recording sheet or an intermediate image transferring unit;

supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

16. An image recording method, comprising the steps of:

forming an electrostatic latent image defined by electrostatic potential differences on an image carrier, the surface of which image carrier is rotatably supported;

forming a toner image by selectively applying toner onto the image carrier;

applying adheringly fine particles as an intervening layer onto a surface of the image carrier between the image carrier and toner, the fine particles having a volume resistivity between $1\times10^{8}$ Ωcm and $1\times10^{14}$ Ωcm and to an intermediate image transferring unit to form a substantially uniform fine particle layer, the particle diameter of the fine particles being smaller than that of the toner;

transferring the toner image formed on the image carrier among the fine particle layer formed on the intermediate image transferring unit;

transferring the toner image from the intermediate image transferring unit to a recording sheet;

supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

17. An image recording method, comprising the steps of:

forming an electrostatic latent image defined by electrostatic potential differences on an image carrier the surface of which is rotatably supported;

forming a toner image by selectively applying toner and adheringly fine particles applied as an intervening layer onto the surface of the image carrier between the image carrier and toner by using as a developing agent a mixture of the toner and the fine particles, the particle diameter of the fine particles being smaller than that of the toner and the fine particles having a volume resistivity between $1\times10^{8}$ Ωcm and $1\times10^{14}$ Ωcm;

projecting an ultrasonic wave to the toner image to vibrate the toner and the fine particles before the toner image is transferred onto a recording sheet or an intermediate image transferring unit;

transferring the toner image onto the recording sheet or the intermediate image transferring unit;

supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

18. An image recording method, comprising the steps of:

forming an electrostatic latent image defined by electrostatic potential differences on an image carrier having a surface, the image carrier being rotatably supported;

forming a toner image by selectively applying toner and powdery particles onto the image carrier by using as a developing agent a mixture of the toner and the powdery particles, the particle diameter of the powdery particles being smaller than that of the toner and the powdery particles having a volume resistivity between $1\times10^{8}$ Ωcm and $1\times10^{14}$ Ωcm and the powdery particles being adheringly applied as an intervening layer onto the image carrier surface between the image carrier and toner;

transferring the toner image onto an intermediate image transferring unit;

projecting an ultrasonic wave to the toner image transferred on the intermediate image transferring unit to vibrate the toner image before the toner image is transferred onto a recording sheet or an intermediate image transferring unit;

transferring the toner image onto the recording sheet;

supplying the fine particles to the surface of the image carrying means to form a substantially uniform layer of the fine particles on the surface of the image carrying means by the particle supplying means disposed facing the image carrying means; and collecting the toner left on the surface of the image carrying means using the particle supplying means after the surface of the image carrying means passes a location facing the image transferring means.

* * * * *